US012311430B2

(12) United States Patent
Caporusso et al.

(10) Patent No.: US 12,311,430 B2
(45) Date of Patent: May 27, 2025

(54) MANDREL FOR PIPE BENDING MACHINE

(71) Applicant: CML INTERNATIONAL S.P.A., Piedimonte S. Germano (IT)

(72) Inventors: Alessandro Caporusso, Piedimonte San Germano (IT); Werner Davide D'Agostino, Villa Latina (IT); Paolo Sacco, Piedimonte San Germano (IT)

(73) Assignee: CML INTERNATIONAL S.P.A., Piedimonte S. Germano (IT)

( * ) Notice: Subject to any disclaimer, the term of this patent is extended or adjusted under 35 U.S.C. 154(b) by 35 days.

(21) Appl. No.: 17/998,023

(22) PCT Filed: Apr. 29, 2021

(86) PCT No.: PCT/IB2021/053564
§ 371 (c)(1),
(2) Date: Nov. 4, 2022

(87) PCT Pub. No.: WO2021/224731
PCT Pub. Date: Nov. 11, 2021

(65) Prior Publication Data

US 2023/0173565 A1 Jun. 8, 2023

(30) Foreign Application Priority Data

May 5, 2020 (IT) ..... 102020000009961

(51) Int. Cl.
*B21D 9/01* (2006.01)

(52) U.S. Cl.
CPC ..... *B21D 9/01* (2013.01)

(58) Field of Classification Search
CPC ..... B21D 9/01; B21D 9/03; B21D 9/00
See application file for complete search history.

(56) References Cited

U.S. PATENT DOCUMENTS 3,286,503 A 11/1966 Garrett
3,408,950 A 11/1968 Othmar
(Continued)

FOREIGN PATENT DOCUMENTS

CN 102728674 A 10/2012
CN 108405684 8/2018
(Continued)

OTHER PUBLICATIONS

Office Action dated Feb. 7, 2025 in JP Patent Application No. 2022-567382, pp. 1-4.

*Primary Examiner* — Teresa M Ekiert
(74) *Attorney, Agent, or Firm* — Byrne Poh LLP

(57) ABSTRACT

A mandrel for pipe bending machine has an elongated body (3) with a first end connected to a mandrel rod and a second end, opposite to the first, in which there is a spherical seat (8), several intermediate articulated elements (10) and a terminal articulated element (11). Each intermediate joint element (10) and the terminal joint element (11) have a peripheral part (12) configured so as to lean against the inner wall of a pipe (T) to be bent. Each intermediate articulated element (10) has a cup-shaped part (13) in one piece, and a stem (19) extending externally from it, and a spheroidal part (21) in one piece, configured so as to be introduced in a cup-shaped part (13) of a previous intermediate articulated element (10).

21 Claims, 12 Drawing Sheets

(56) References Cited

U.S. PATENT DOCUMENTS

| | | | | |
|---|---|---|---|---|
| 4,315,423 | A | 2/1982 | McGuire | |
| 4,542,637 | A * | 9/1985 | McGuire | B21D 9/03 72/466 |
| 4,635,464 | A * | 1/1987 | McGuire, Sr. | B21D 9/03 72/466 |
| 6,085,572 | A | 7/2000 | McGuire et al. | |
| 2018/0085809 | A1 * | 3/2018 | Ghiotti | B21D 9/03 |

FOREIGN PATENT DOCUMENTS

| | | |
|---|---|---|
| JP | S60-234723 | 11/1985 |
| JP | 2015-96267 | 5/2015 |

* cited by examiner

Fig. 12
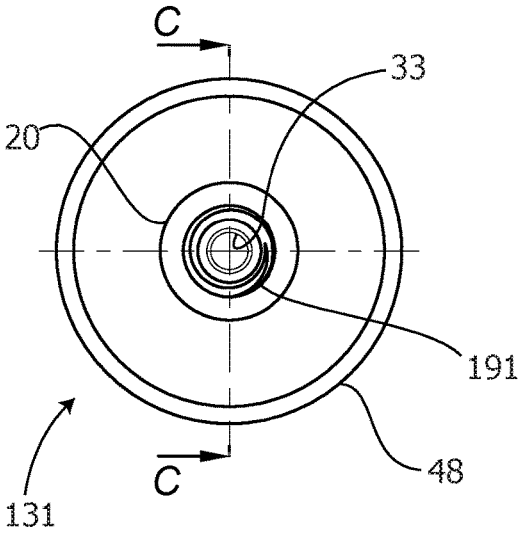
Fig. 13
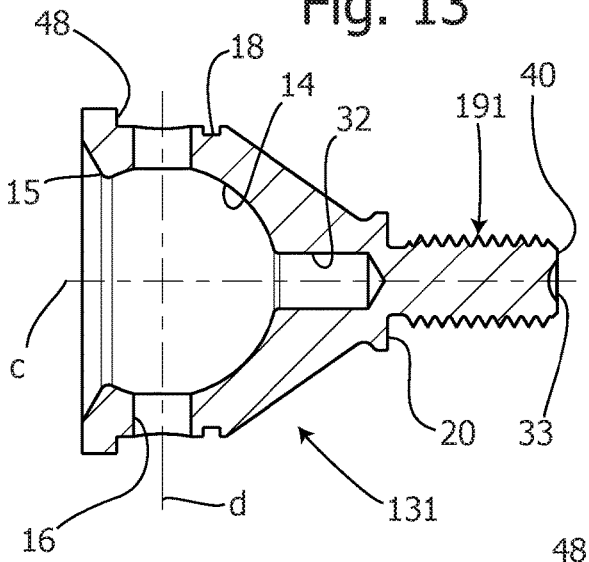
Fig. 16
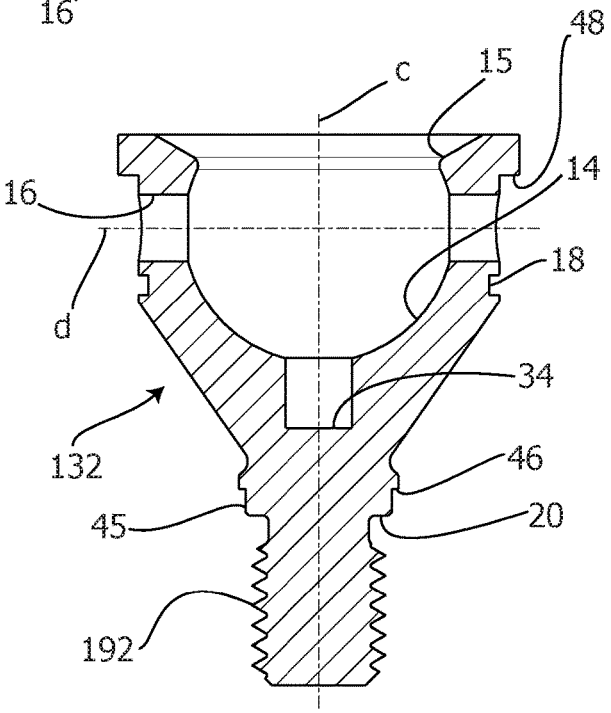
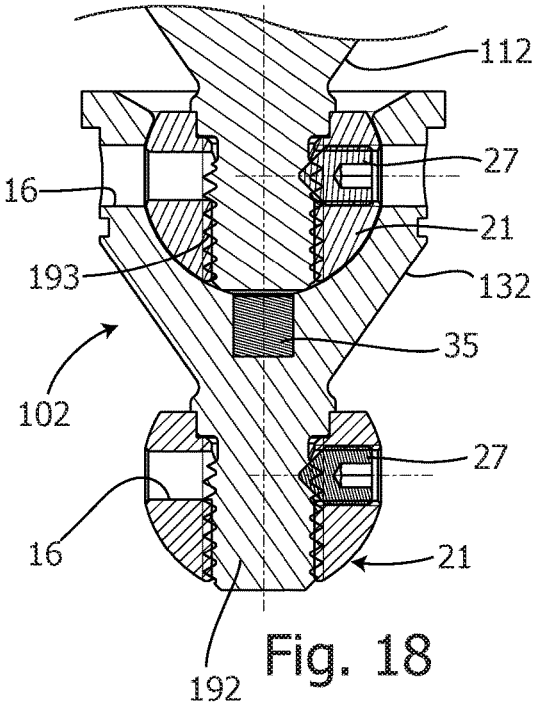
Fig. 18
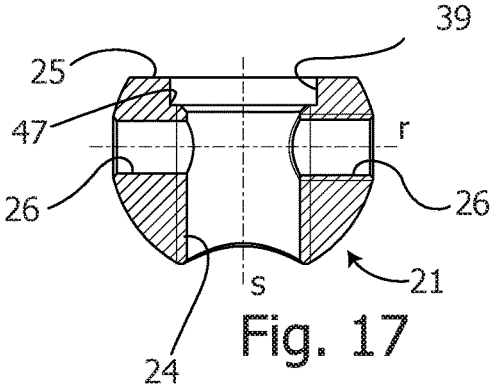
Fig. 17

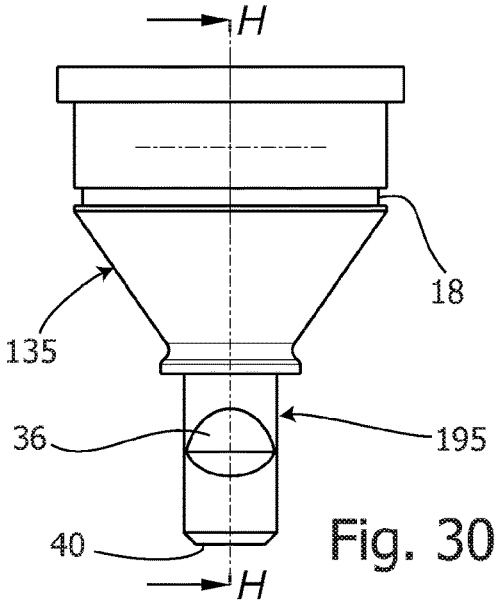
Fig. 30
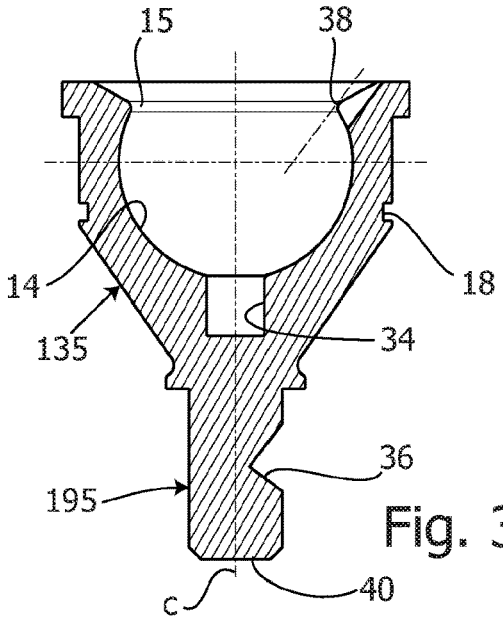
Fig. 31
Fig. 32
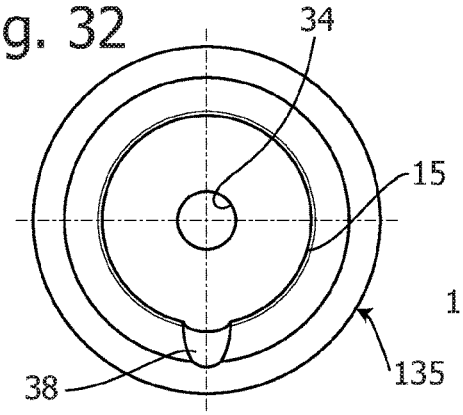
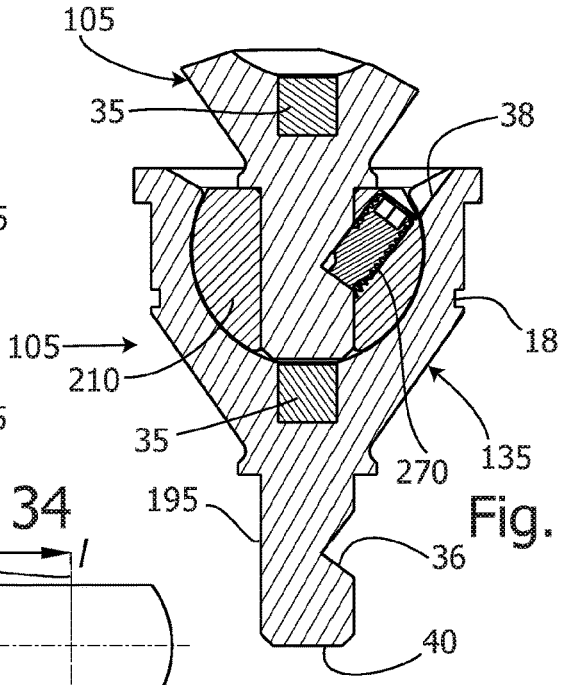
Fig. 37
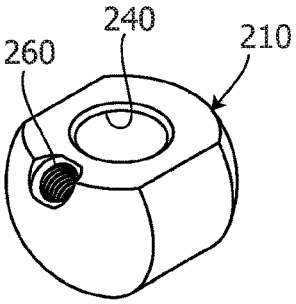
Fig. 33
Fig. 34
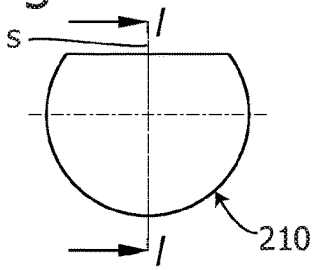
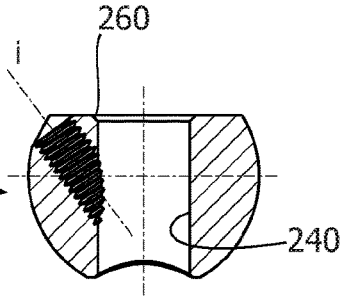
Fig. 35
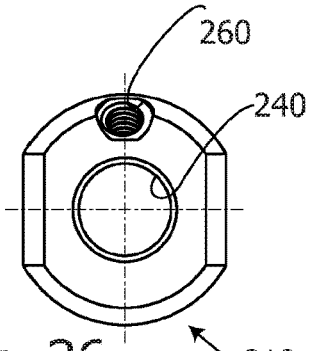
Fig. 36

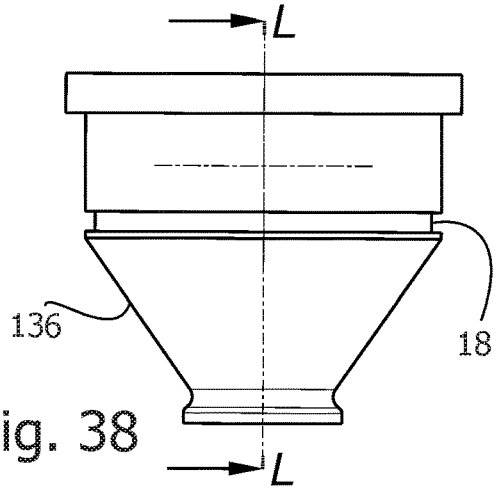
Fig. 38
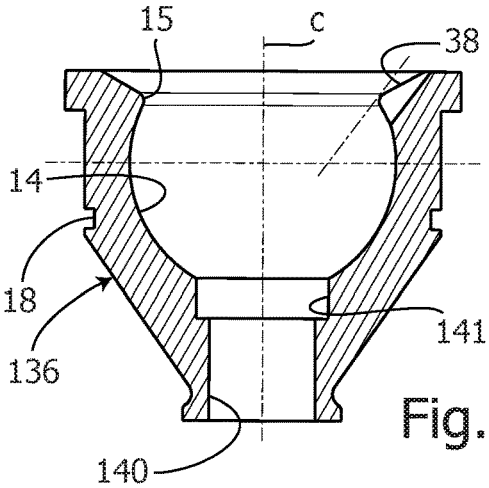
Fig. 39
Fig. 40
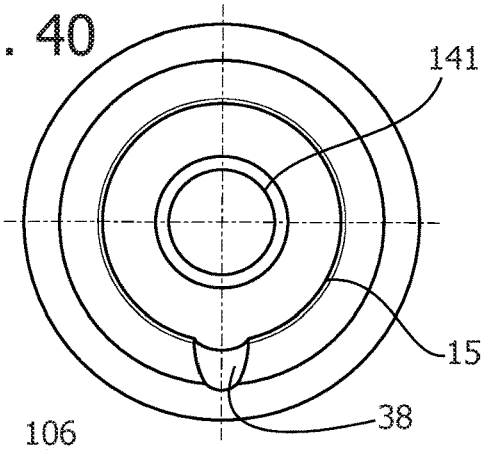
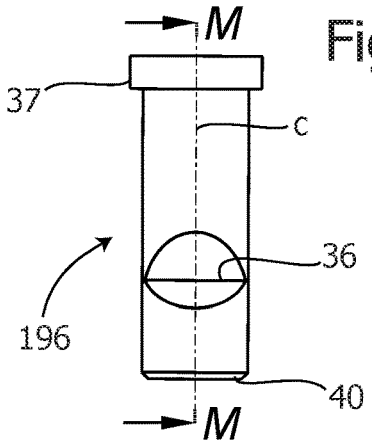
Fig. 43
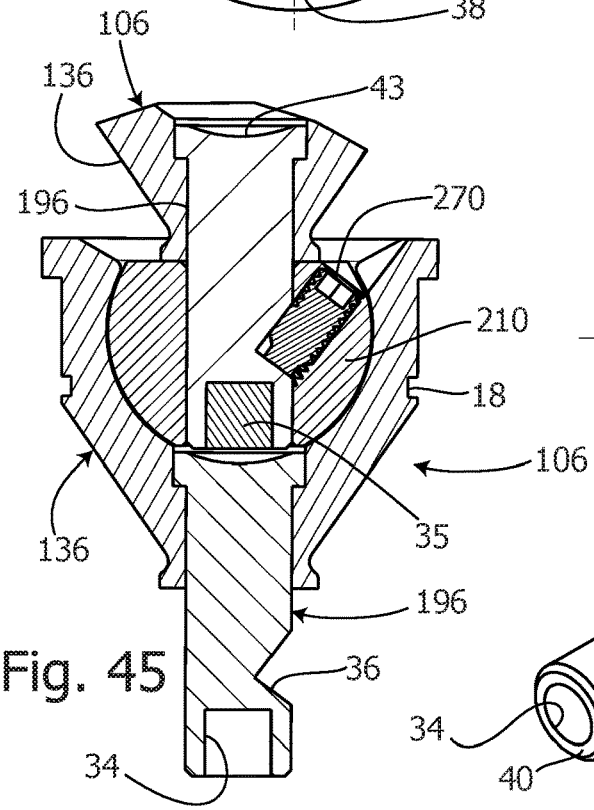
Fig. 45
Fig. 42
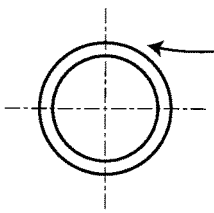
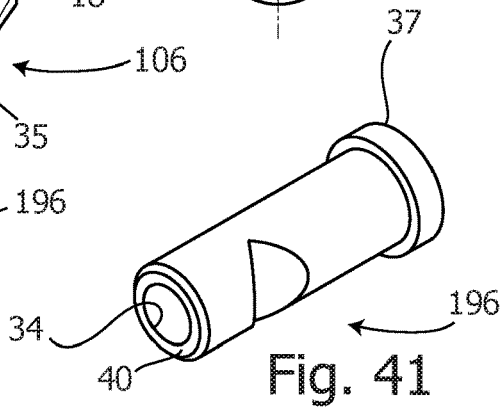
Fig. 41
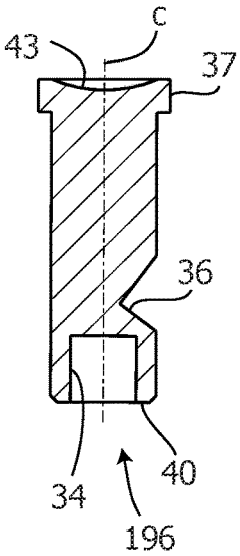
Fig. 44

MANDREL FOR PIPE BENDING MACHINE

TECHNICAL FIELD

The present invention refers to a mandrel for pipe bending machine.

It is known that the mandrels for bending pipes are used to support the inside of a pipe while it is being bent. The mandrel is inserted in the section of pipe to be bent, and when bending occurs, the flexible portion of the mandrel bends with the pipe, supporting the inside and preventing it from collapsing or deforming unnecessarily.

BACKGROUND ART

U.S. Pat. No. 4,635,464 discloses a mandrel for bending pipes including a rectilinear portion and a flexible portion. The rectilinear portion includes a rod received by a threaded coupling within a mandrel shank hole, which is in turn connected to a shank joint. The shank joint is made in two specularly identical parts to receive inside a male of an intermediate articulated element also made in two identical halves. The two identical halves are joined by an annular component having spherical peripheral surfaces intended to come into contact with the pipe to be bent. The annular component is screwed onto the two halves of the articulated element. Inside each intermediate articulated element there is a blind hole designed to house a spring-loaded ball. The female seat in which the male of the articulated element is located has a recess at its bottom intended to receive and hold the ball so that in the non-operative position the articulated elements are aligned with each other to facilitate the introduction of the mandrel into the pipe to be bent. The terminal articulated element is devoid of the female component because it is not used to create a new connection for an articulated element, and therefore it does not need to be made in two halves.

It is understood that articulated elements such as those described above must be manufactured with considerable precision because the internal thread of the annular component must screw onto the two external threads of two distinct opposing pieces in the same articulated element.

To solve this problem, U.S. Pat. No. 6,085,572 describes a mandrel similar to that of the aforementioned patent, in that both the shank joint and the intermediate articulated elements are made in two halves that can be assembled together according to a central axial plane. However, unlike the aforementioned patent, the annular component which joins the two halves and comes into contact with the walls of the pipe to be bent, is held thereto by elastic rings.

This solution obviates the drawback of the threaded coupling of the two parts of the articulated element with the annular component. However, there remains the need to produce the two half pieces in the mandrel with considerable precision. Being made in two halves, these pieces have limited resistance in use.

U.S. Pat. No. 3,408,850 discloses a pipe bending mandrel comprising a series of outer, internally threaded ball members and a series of inner ball-link members connected together in end to end relation; each ball-link member has a spherically shaped, segmented male portion formed at one end thereof and a segmented female portion formed at the other end thereof. Said female portion includes two externally threaded, longitudinally extending parts the inner surfaces of which cooperate to circumscribe the major portion of said spherically shaped recess.

It is understood, therefore, that the female portion or ball shaped portion is made in two parts and not in one piece.

U.S. Pat. No. 3,286,503 provides a tubing bending mandrel having a rigid tract and a flexible tract removably connected to the rigid tract. The flexible tract of the mandrel consists of links, each link having a link ball o male part movable in a respective female part, and mandrel balls. Each link ball is made of two portions counterposed along a meridian plane; the female part is composed of an externally threaded cup-shaped section extending in a distinct externally threaded cylindrical sector, both the cup-shaped section and the cylindrical sector being screwed to an internal threading made in the mandrel ball. In order to effect removable mounting of each female part in each link, to permit ready replacement in case of damage to any of the balls, it is necessary to remove the cylindrical sector of the female portion.

It is understood, therefore, that each of the both female parts and male parts of the mandrel flexible tract according to U.S. Pat. No. 3,286,503 is made in two parts and not in one piece.

SUMMARY OF THE INVENTION

The present invention aims to overcome the drawbacks arising from the fact that, in the prior art, the flexible portion of the mandrel is manufactured with link elements having either the female component or the male component or both made in at least two parts to be combined together in the assembly of the flexible portion of the mandrel before use.

An object of the present invention is to manufacture in one piece both the female component and the male component of the flexible portion of a mandrel.

Another object of the present invention is to provide a flexible portion of the mandrel that can be prepared for use in a simple and quick way.

A further object of the present invention is to provide a flexible portion of the mandrel which has higher mechanical strength features than those of the prior art.

Yet another object of the invention is to provide articulated elements in a number of parts lower than that of the prior art and therefore easier and quicker to assemble than before.

A further object of the present invention is to provide articulated elements formed by easily replaceable parts in case of damage or wear.

The aforementioned and other purposes are achieved by a mandrel for a pipe bending machine, comprising an elongated body having a first end connected to a mandrel rod and a second end, opposite the first, in which there is a spherical seat, and at least an intermediate articulated element and a terminal articulated element.

Each intermediate articulated element comprises a ball joint one-piece cup-shaped part, equipped with a spherical seat, and a stem extending externally from the one-piece cup-shaped part, and a spheroidal part in one piece, configured to be introduced in said spherical seat.

As each spherical joint is composed only of a one-piece male component and a one-piece female component, the spherical joint does not require a structural accuracy as the flexible portions of the mandrel of the prior art.

To allow the introduction of the spheroidal part, as a male component, in the spherical seat or female component, while maintaining at the same time the functionality of a ball joint, in which the male component and the female component are in close contact with each other, the spheroidal part is configured like a peripherally lightened sphere.

The spheroidal part is preferably a solid formed by a cylinder whose opposite bases are spherical caps of the same sphere, having the same axis which is perpendicular to a central axis of the spheroidal part. The diameter of said sphere is slightly smaller than that of the spherical seat of the female component.

Advantageously, said solid is delimited by a flat face by means of a secant plane perpendicular to said central axis. In addition, the solid has a main hole directed along the central axis of the spheroidal part for the insertion of the stem.

Advantageously, the male component has at least one secondary threaded hole, that is transversal, or a tertiary threaded hole, that is inclined, for the insertion of a set screw.

The set screw in the secondary threaded hole is able to block a threaded stem against its unscrewing from the spheroidal part, while the set screw in the tertiary threaded hole is able to block a smooth stem in the spheroidal part.

BRIEF DESCRIPTION OF DRAWINGS

The present invention will be described with reference to its preferred embodiments, and relevant variants, considered together with the attached drawings, in which:

FIG. 12 is an end view similar to that in FIG. 3 of a first variant of the cup-shaped part and the stem of the intermediate articulated element in FIG. 11;

FIG. 13 is a cross-section view taken along the line C-C in FIG. 12;

FIG. 16 is a cross-section view taken along the line D-D in FIG. 15;

FIG. 17 is similar to FIG. 7 showing a first variant of the spheroidal part;

FIG. 18 is a partial longitudinal cross-section view of two intermediate articulated elements using the second variant of cup-shaped part and stem in FIG. 16 and the first variant of the spheroidal part in FIG. 17;

FIG. 30 is a side view of a fifth variant of cup-shaped part and stem of an intermediate articulated element according to the present invention;

FIG. 31 is a cross-section view taken along the line H-H in FIG. 30;

FIG. 32 is a front end view of the fifth variant of the cup-shaped part in FIG. 30;

FIG. 33 is an axonometric view of a second variant of the spheroidal part according to the present invention;

FIG. 34 is a rear end view of the second variant of the spheroidal part in FIG. 33;

FIG. 35 is a cross-section view taken along the line I-I in FIG. 34;

FIG. 36 is a top plan view of the second variant of the spheroidal part in FIG. 33;

FIG. 37 is a partial longitudinal section of two intermediate articulated elements using the fifth variant of cup-shaped part and stem in FIG. 30 and the second variant of spheroidal part in FIG. 33;

FIG. 38 is a side view of a sixth variant of a cup-shaped part of an intermediate articulated element according to the present invention;

FIG. 39 is a cross-section view taken along the line L-L in FIG. 38;

FIG. 40 is a front end view of the sixth variant of the cup-shaped part in FIG. 38;

FIG. 41 is an axonometric view of a second variant of the stem according to the present invention;

FIG. 42 is a front end view of the second variant of the stem in FIG. 41;

FIG. 43 is a side view of the second variant of the stem in FIG. 41;

FIG. 44 is a cross-section view taken along the line M-M in FIG. 43;

FIG. 45 is a partial longitudinal section of two intermediate articulated elements using the sixth variant of the cup-shaped part in FIG. 38, the second variant of the spheroidal part in FIG. 33 and the second variant of stem in FIGS. 41.

DESCRIPTION OF EMBODIMENTS OF THE INVENTION

Figure 1:
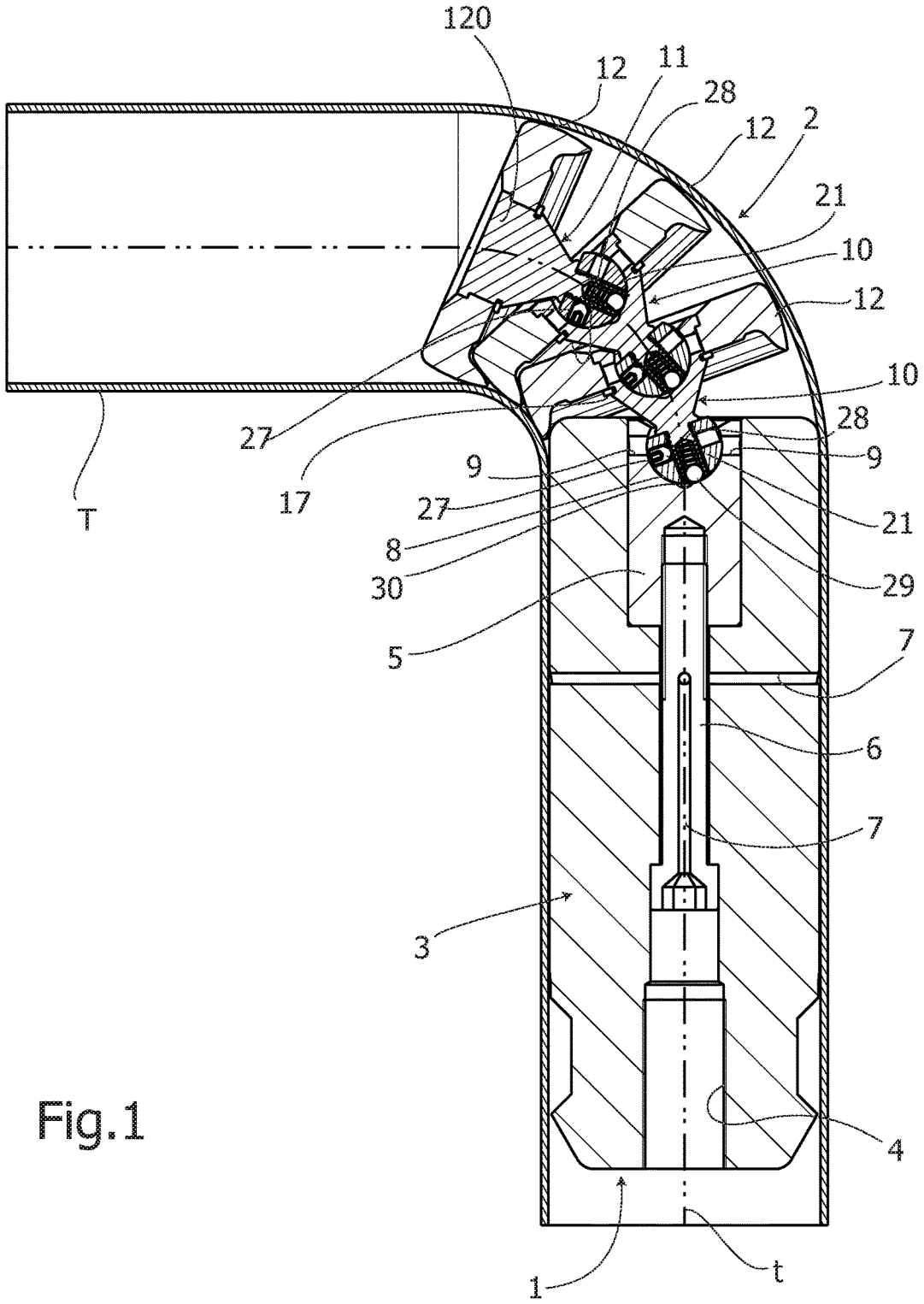
FIG. 1 shows an axial longitudinal cross-section of a first embodiment of a mandrel for pipe bending machine according to the present invention inside a pipe after a 90° bending operation of the same.

The invention is described in embodiments and variants, which are illustrated in the figures in which the same or similar parts are marked with the same reference numbers.

Conventionally, the mandrel for bending tubes has a rectilinear portion 1 and a flexible portion 2, as shown in the axial longitudinal cross-section views in FIGS. 1, 11, 14, 19 inside a pipe T already bent at 90°. The pipe can have a circular or polygonal cross-section.

The rectilinear portion 1 has an elongated body 3 conventionally connected by a thread 4 to a mandrel rod not shown. The elongated body 3 has an axis t coinciding with the axis of the pipe T to be bent. The elongated body 3 has inside a preferably cylindrical cavity in which an insert 5 having a spherical seat 8 for a spherical joint is housed. The insert 5 is held by a screw 6, shown in the Figures as a hex screw bolt. Traditionally, the elongated body 3 has lubrication channels, generically indicated by 7, communicating with the inside of the pipe T. According to the invention, the insert 5 is made in one piece coaxially to the pipe T which also coincides with the axis central t of the elongated body 3. Obviously, the rectilinear portion 1 is intended to remain, in a bending operation, in a straight portion of the pipe T to be bent. The spherical seat 8 of the insert 5 communicates, through at least one hole 9 with the elongated body 3.

The flexible portion 2 comprises at least one intermediate articulated element 10 and a terminal articulated element 11, each surrounded by a peripheral part 12 configured so as to rest against the inner wall of a pipe T to be bent. If the pipe is cylindrical, the peripheral part is in the shape of a spherical segment intended to come into contact with the cylindrical walls of the pipe T to be bent. If the pipe T to be bent has a polygonal shape, for example square or rectangular, the peripheral part is shaped accordingly. According to the first embodiment of the invention, each intermediate articulated element 10 and the terminal articulated element 11 are inserted into the central hole of their peripheral part 12 and held there in a conventional manner.

Figure 3:
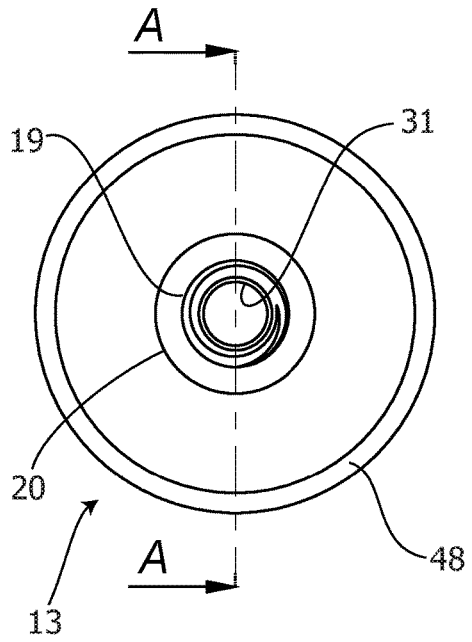
FIG. 3 is a rear end view of the cup-shaped portion and the stem of the intermediate articulated element in FIG. 2.
Figure 4:
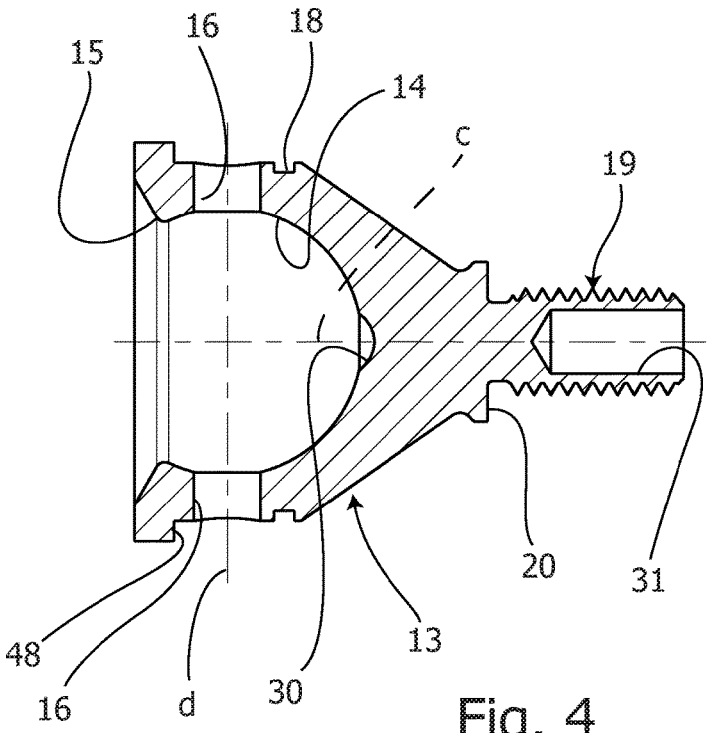
FIG. 4 is a cross-section view taken along the line A-A in FIG. 3.
Figure 2:
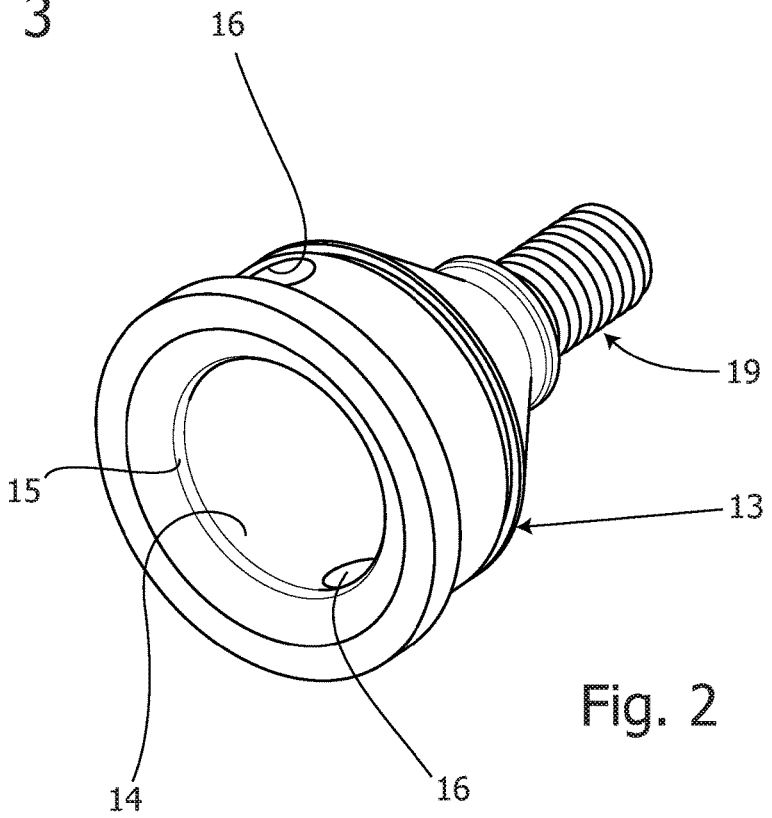
FIG. 2 is an enlarged perspective view of a cup-shaped part and a stem of an intermediate articulated element in FIG. 1.
Figure 5:
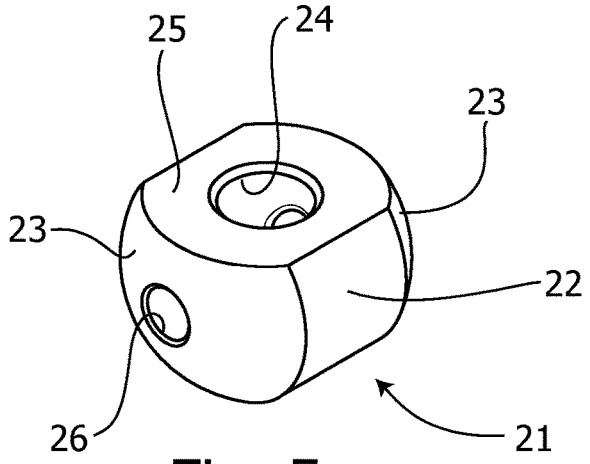
FIG. 5 is an enlarged perspective view of a male component or spheroidal part of an intermediate articulated element in FIG. 1.
Figure 6:
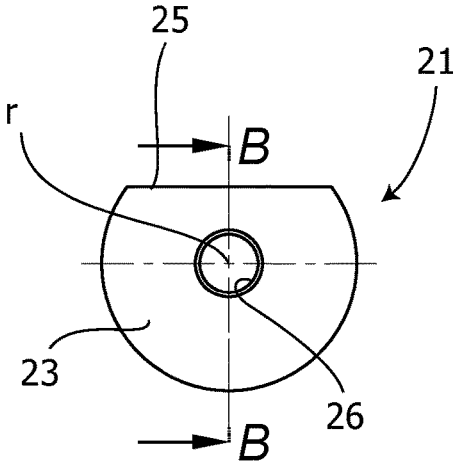
FIG. 6 is an end view of the male component in FIG. 5.
Figure 7:
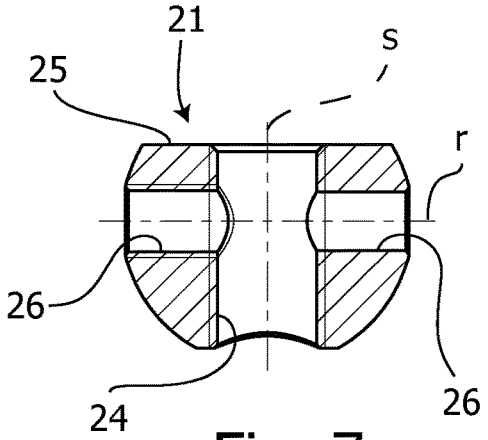
FIG. 7 is a cross-section view taken along the line B-B in FIG. 6.
Figure 8:
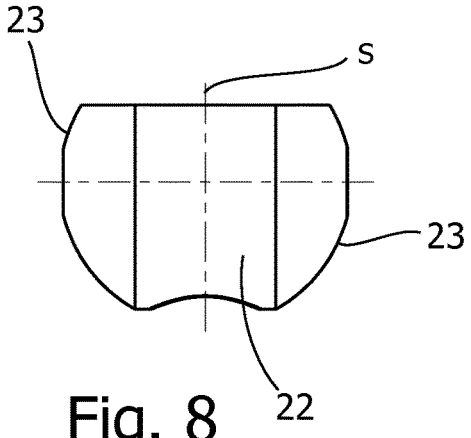
FIG. 8 is a side view in FIG. 5.
Figure 10:
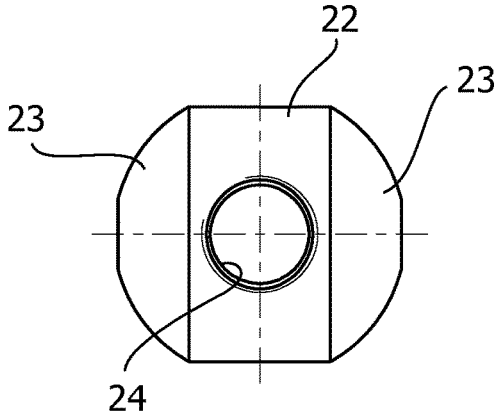
FIGS. 9 and 10 are top and bottom views of the male component in FIG. 5 respectively.
Figure 9:
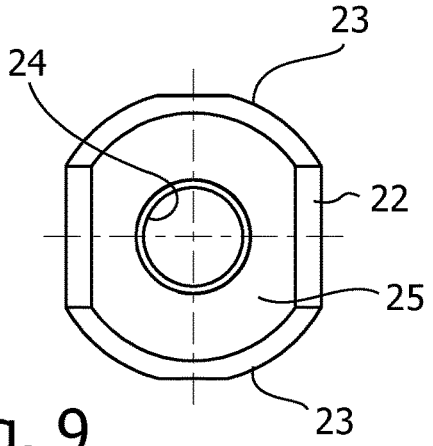

Reference is now also made to FIGS. 2, 3 and 4 which are, respectively, a perspective view on an enlarged scale of cup-shaped part and stem of an articulated element in FIG. 1, a rear end view of the cup-shaped portion and the stem of the intermediate articulated element in FIG. 2 and a cross-section view taken along lines A-A in FIG. 3. Each intermediate articulated element 10 comprises a one-piece cup-shaped part 13 of a ball joint, having a central axis c. The cup-shaped part 13 has a spherical seat 14 with a determined internal diameter. The spherical seat 14 is substantially shaped as a partial spherical cavity delimited on the outside by a circumferential edge 15 transversally protruding in a projection 48.

At least one hole 16, two in the embodiment shown, is made according to a transverse axis d, perpendicular to the central axis c whose purpose will be explained later.

The circumferential edge 15 prevents the male component of the ball joint from coming out, as will be seen below. The circumferential edge 15 extends transversely to the outside in the projection 48 that abuts in a known manner with a corresponding shoulder made in the peripheral part 12 when the cup-shaped part 13 is inserted into it. The cup-shaped part 13 is held in the peripheral part 12 by means of an elastic ring 17 (FIG. 1) housed in a groove 18 of the cup-shaped part 13.

The cup-shaped part 13 of the intermediate articulated element extends into a stem 19 extending externally from it along its central axis c. Stem 19 is threaded. Between the cup-shaped part 13 and the stem 19 there is an annular surface 20 which acts as an abutment plane for a male component of the ball joint, hereinafter called spheroidal part 21. The spheroidal part 21 is shown in FIGS. 5, 6, 7, 8, 9 and 10 with an enlarged perspective view, its orthogonal views and a cross-section view taken along line B-B in FIG. 6.

The spheroidal part 21 is in one piece and has a central axis s. It is configured in such a way as to be introduced into the spherical seat 8 of the insert 5 of the elongated body 3 or into the spherical seat 14 of the cup-shaped part 13 of the intermediate articulated element, and be retained therein. For this purpose, the spheroidal part 21 is substantially a lightened sphere which can be thought to be formed by a cylinder 22 whose opposite bases are spherical caps 23, 23 of a same sphere. The cylinder 22 which joins the two spherical caps 23, 23 could be replaced by a prism or other elongated shape since only the spherical caps 23, 23 come into contact with the spherical seat 8 of the insert 5 or with the spherical seat 14 of the cup-shaped part 13 of the intermediate articulated element. The spheroidal part 21 has a main threaded hole 24 directed according to the central axis s and is delimited by a flat face 25 by means of a secant plane perpendicular to its central axis s. The stem 19 extending from the cup-shaped part 13 is screwed into the main threaded hole 24 of the spheroidal part 21. Furthermore, the spheroidal part 21 is provided with at least one secondary threaded hole 26 having a transverse axis r perpendicular to the axis s of the main threaded hole 24. The secondary threaded hole 26 is adapted to receive a set screw 27 (FIG. 1) capable of locking the stem 19 screwed onto the spheroidal part 21. The set screw 27 is inserted both in the cup-shaped part 13 of the intermediate articulated elements 10 through the holes 16 and in the ball joint insert 5 of the elongated body 3 through the holes 9, before the intermediate articulated elements 10 are inserted inside their peripheral part 12 and the insert 5 is inserted in the elongated body 3.

According to the first embodiment shown in FIG. 1, the stem 19 has a free end in which a blind hole 31 (FIG. 4) coaxial to the central axis c of the cup-shaped part 13 is obtained. The blind hole 31 is suitable to house a pre-compressed helical spring 28 and a ball 29. Both the spherical seat 14 of the cup-shaped part 13 of the intermediate articulated elements 10, and the spherical seat 8 of the insert 5 of the elongated body 3 have a depression 30 in the shape of a spherical cap with axis coinciding with the respective central axes t and c. The depression 30 in the shape of a spherical cap is adapted to receive and hold the ball 29 loaded by the helical spring 28 in the blind hole 31 of the stem 19. As is known, this arrangement serves to keep the flexible portion 2 of the mandrel straight when it is not in place and when it needs to be inserted into a new pipe to be bent.

Figure 11:
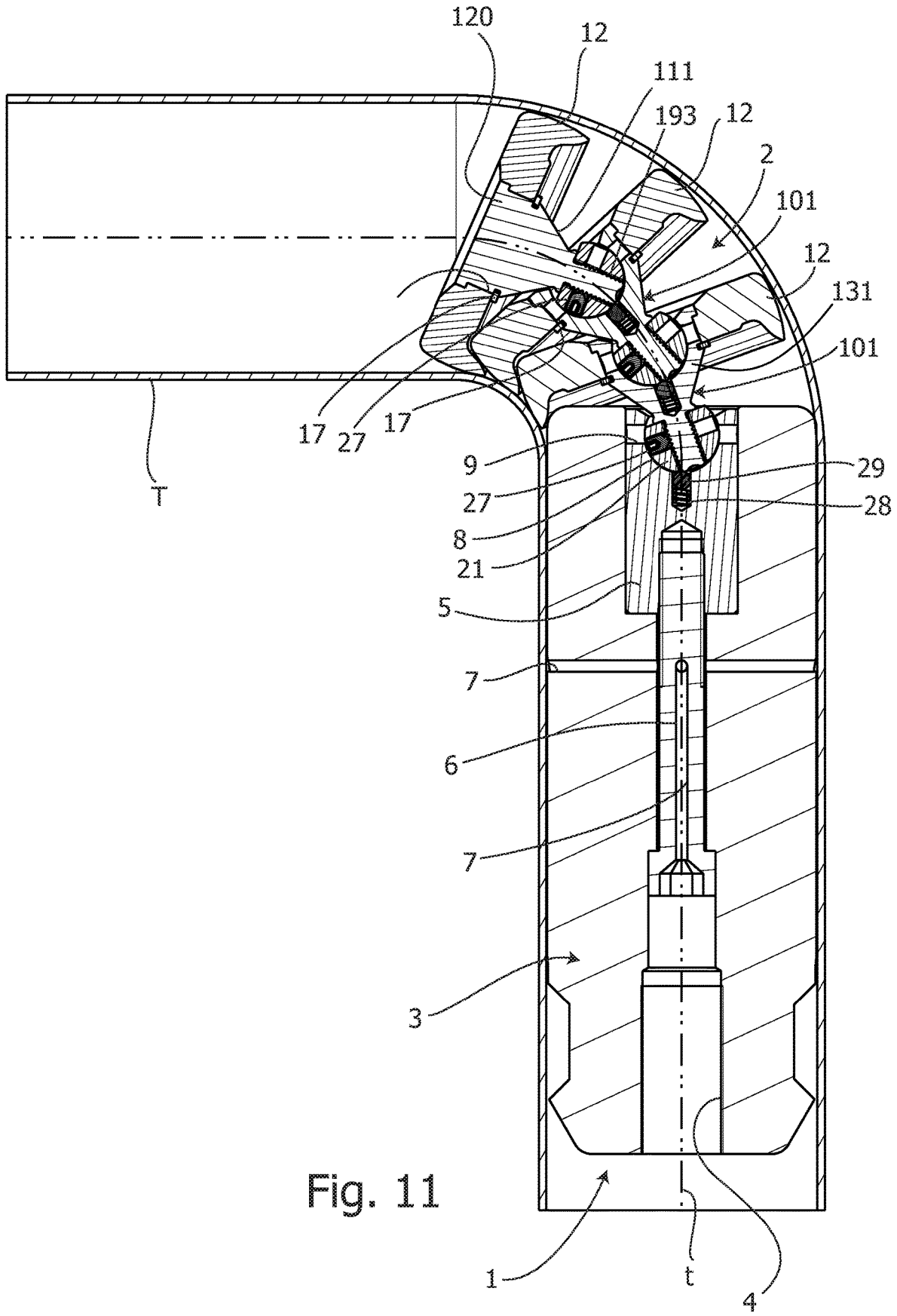
FIG. 11 shows an axial longitudinal cross-section view of a second embodiment of a mandrel for pipe bending machine according to the present invention inside a pipe after a 90° bending operation of the same, in which a first variant of cup-shaped part and stem of the intermediate articulated element is used.

Reference is made now to FIG. 11, which shows in axial longitudinal cross-section view a second embodiment of a mandrel according to the present invention with insert 5, intermediate articulated elements 101 and terminal articulated element 111, all slightly modified with respect to the first embodiment. In FIG. 11 it can be seen that the insert variant 5 of the elongated body 3 and the first variant of the cup-shaped part 131 of the intermediate articulated elements 101 have a blind hole 32.

FIGS. 12 and 13 show the first variant of cup-shaped part 131 in a rear end view and in cross-section view along the line C-C. In particular, FIG. 13 shows in detail the blind hole 32 in the cup-shaped part 131, coaxial to the central axis c. The blind hole 32 is adapted to house a pre-compressed helical spring 28 and a ball 29. The stem 191, also, of the intermediate articulated elements 101 and the terminal articulated element 111 is threaded.

The stem 191 of the intermediate articulated element 101, like that of the terminal articulated element 111, has, in the free end 40, a depression 33 in the shape of a spherical cap with axis coinciding with the central axis c of the cup-shaped part 131 As in the first embodiment, the depression 33 in the shape of a spherical cap is adapted to receive and hold the ball 29 loaded by the helical spring 28 in the blind hole 32 of the insert 5 of the elongated body 3 and of the cup-shaped part 131 of the intermediate articulated elements 101.

Figure 14:
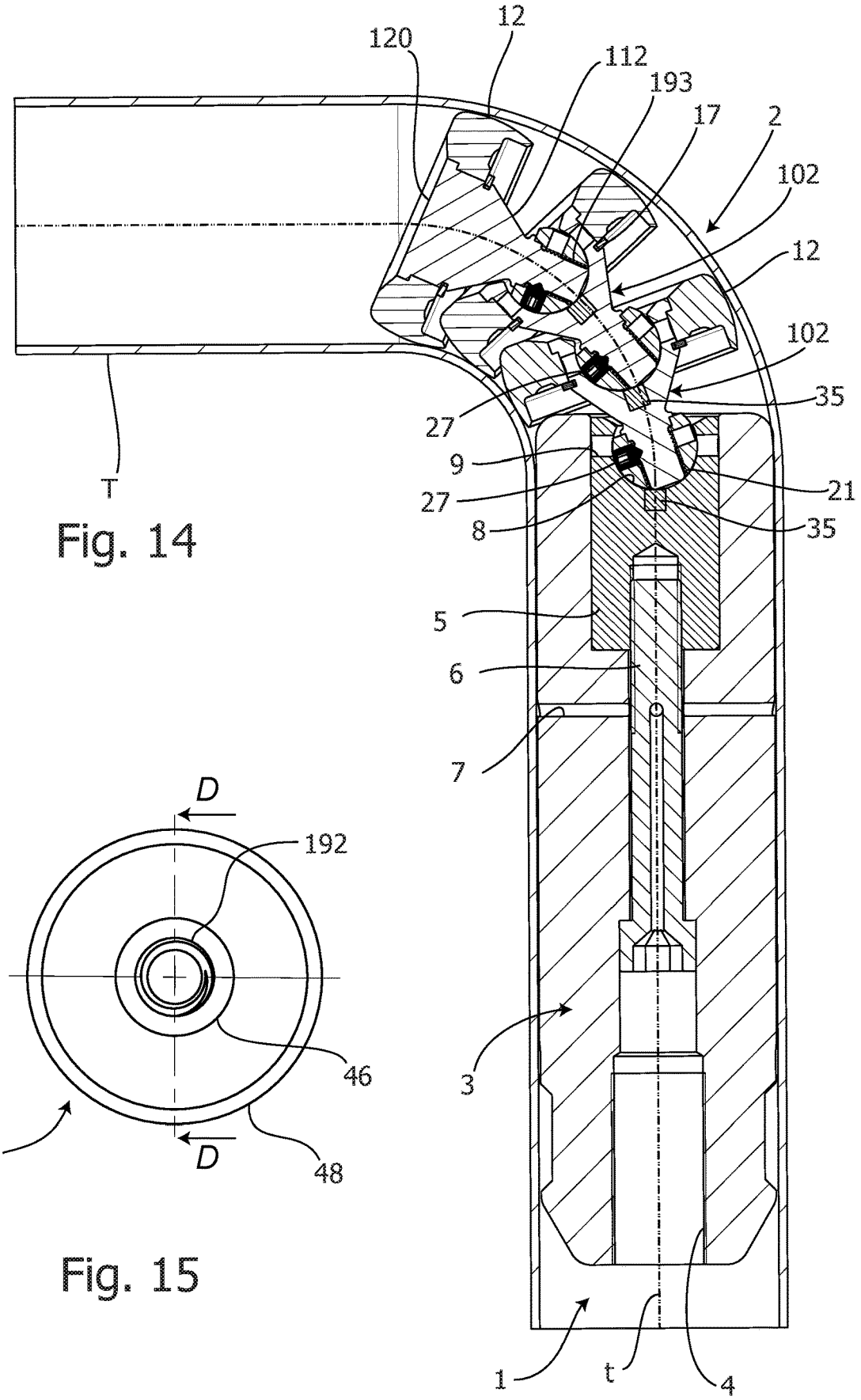
FIG. 14 shows an axial longitudinal cross-section view of a third embodiment of a mandrel for pipe bending machine according to the present invention inside a pipe after a 90° bending operation of the same, in which a second variant of cup-shaped part and stem of the intermediate articulated element is used.
Figure 15:
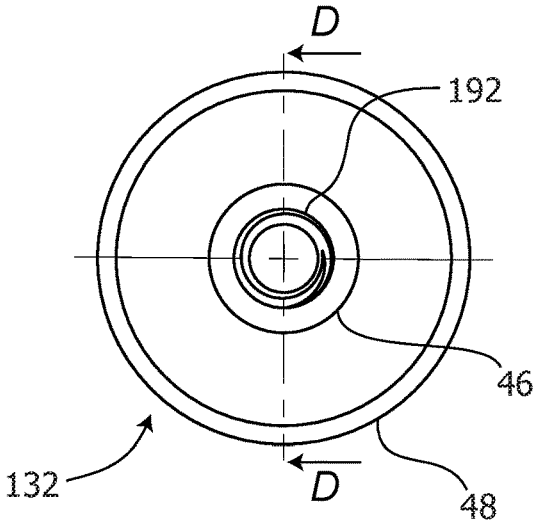
FIG. 15 is an end view similar to that in FIG. 3 of the second variant of the cup-shaped part of the intermediate articulated element in FIG. 14.

Reference is made now to FIG. 14, which shows in axial longitudinal cross-section view a third embodiment of a mandrel according to the present invention with insert 5, intermediate articulated elements 102 and terminal articulated element 112, all slightly modified with respect to the second embodiment. FIGS. 15 and 16 show a second variant of cup-shaped part 132 in rear end view and in cross-section view along the line D-D. FIG. 17 is similar to FIG. 7 and shows a first variant of a spheroidal part with a small difference which will be described later. Since the difference is small, the spheroidal part retains the reference number 21. FIG. 18 is a partial longitudinal cross-section view of two intermediate articulated elements using the second variant of the cup-shaped part 132 in FIG. 16 and the first variant of the spheroidal part 21 in FIG. 17.

In FIG. 14 it is noted that both the insert 5 of the elongated body 3 and the cup-shaped part 132 of the intermediate articulated elements 102 have a blind hole 34, preferably cylindrical. FIG. 16 shows in detail the blind hole 34 in the cup-shaped part 132, coaxial to the central axis c. The blind hole 34 is adapted to house a permanent magnet 35, preferably a neodymium magnet (FIG. 14). The permanent magnet 35 has dimensions such as to be received and retained in the blind hole 34. The stem 192 of the intermediate articulated elements 102 and the stem 193 of the terminal articulated element 112, both threaded and made of a ferrous material, are attracted by the permanent magnet 35 in such a way as to automatically keep the flexible portion 2 of the mandrel straight against gravity before it is introduced into a pipe to be bent.

As already mentioned previously, the spheroidal part 21 is inserted into the spherical seat 14 of the cup-shaped part 132 after having inserted the permanent magnet 35 into the cavity of the blind hole 34. At this point the stem 192 of the intermediate articulated element 102 or the stem 193 of the terminal articulated element 112 can be screwed on the spheroidal part 21. The spheroidal part 21 has a seat 39 for receiving an abutment portion 45 located between the cup-shaped part 132 and the threaded stem 192. The abutment portion 45 adjoins a step 46 intended to strike the flat face 25 of the spheroidal part 21 when the stem 192 is completely screwed into the main hole 24 of the spheroidal part 21. In this position, the annular surface 20 of the threaded stem 192 is in contact with the base 47 of the seat 39 of the spheroidal part 21. Thanks to the abutment portion 45 of the stem 192, the abutment portion 45 being positioned after screwing into the seat 39 of the spheroidal part 21, a backlash is reduced in mutual coupling; thus wear of the parts in the use of the mandrel according to the invention and risk of out of service are reduced.

To improve the sealing of the ball joint thus made, a set screw 27 is inserted in a hole 16 of the cup-shaped part 132 so as to block the thread of the stem 192 or 193 against unscrewing.

Figure 19:
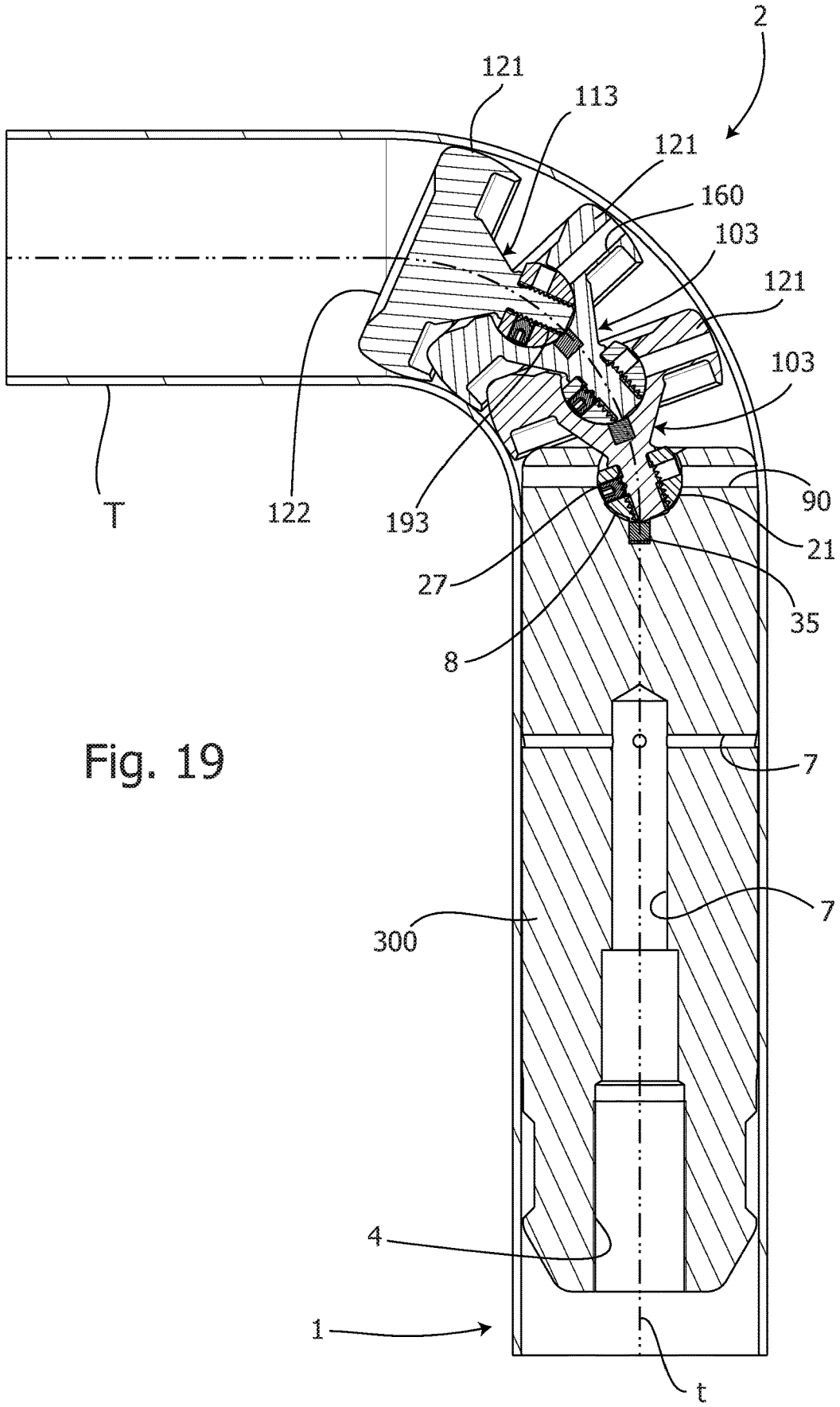
FIG. 19 shows an axial longitudinal cross-section view of a fourth embodiment of a mandrel for pipe bending machine according to the present invention inside a pipe after a 90° bending operation of the same in which a third variant of cup-shaped part and stem of the intermediate articulated element is used.

Reference is made now to FIG. 19, which shows in an axial longitudinal cross-section view a fourth embodiment of a mandrel according to the present invention. Elongated body 300, intermediate articulated elements 103 and terminal articulated element 113 are modified. It is noted that, unlike the previous embodiments, in which the spherical seat 8 is made in the insert 5 of the elongated body 3, in the rectilinear portion 1 of the mandrel according to the fourth embodiment the spherical seat 8 is obtained directly in the elongated body 300. The elongated body 300 is adapted to be connected in its first end to a mandrel rod (not shown) by means of a threaded coupling 4; it has lubrication channels, generically indicated with 7, communicating with the inside of the pipe T. In its second end, the elongated body 300 is provided with at least one hole 90 (2 in number in FIG. 19), which is perpendicular to the central axis t of the cylindrical body 300, and communicates with the inside of the pipe T. The hole 90 allows the passage of the set screw 27 when the spheroidal part 21 is inserted in the spherical seat 8 and the hole 90 is coaxial with the secondary threaded hole 26 of the spheroidal part 21, as shown in FIGS. 5, 6, 7, 8, 9 and 10.

In the fourth embodiment, the flexible portion 2 of the mandrel also has some differences with respect to the previous embodiments.

Figure 20:
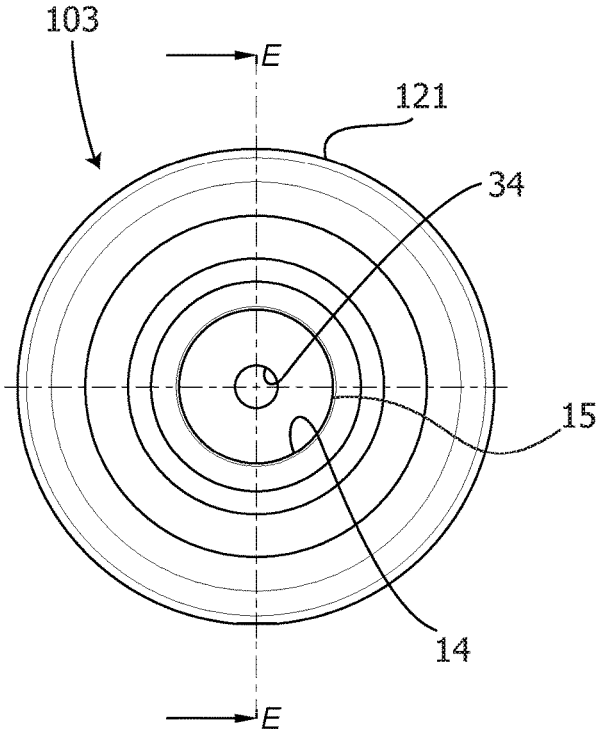
FIG. 20 is a front end view of the third variant of the cup-shaped part and stem of the intermediate articulated element in FIG. 19.
Figure 21:
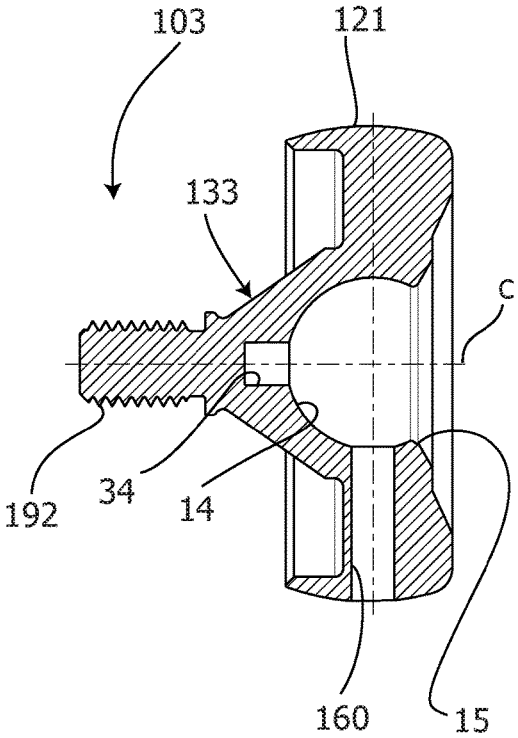
FIG. 21 is a cross-section view taken along the line E-E in FIG. 20.

In the intermediate joint elements 103, the peripheral part 121 is in one piece with the cup-shaped part 133, as shown in detail in FIGS. 20 and 21, which are an enlarged front end view of the cup-shaped part of the element intermediate joint of FIG. 19 and, respectively, a section obtained along the line EE of FIG. 20. The peripheral part 121 is represented as a spherical segment, and in this case the mandrel is intended for a cylindrical pipe to be bent. The peripheral part 121 is provided with a hole 160 which connects the inside of the pipe T with the spherical seat 14 of the cup-shaped part 133. The hole 160, which is perpendicular to the central axis c of the cup-shaped part 133, is adapted to allow the passage of the set screw 27 when the spheroidal part 21 is inserted in the spherical seat 14 and the hole 160 is coaxial with the secondary threaded hole 26 of the spheroidal part 21 (FIG. 19).

Figure 22:
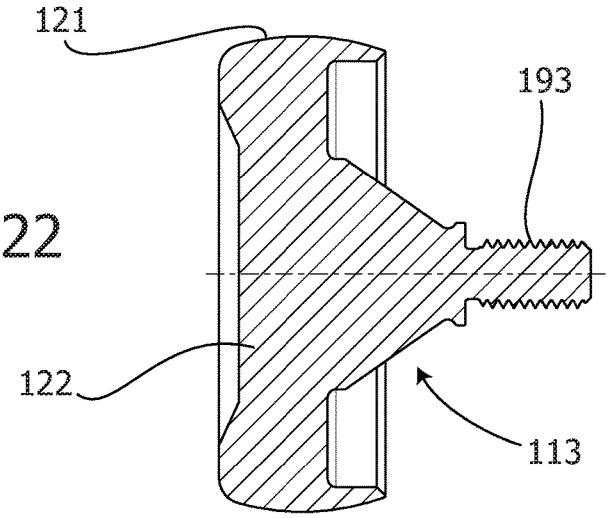
FIG. 22 is a cross-section view similar to that in FIG. 21 of the externally cup-shaped part and the stem of the articulated end element in FIG. 19.

As can be seen from FIG. 19 and FIG. 22 which is a section, similar to that of FIG. 21, of the terminal articulated element 113 according to the fourth embodiment, the peripheral part 121 with spherical segment is also in one piece with the cup-shaped part 122. It is evident that, if the pipe to be bent has a square section, the peripheral part of the intermediate and terminal articulated elements have a square outline, as well as the elongated body 300.

It should be understood that the one-piece construction of the peripheral part with the cup-shaped part in the articulated end element 113 reduces the number of pieces making up the mandrel and therefore its manufacturing costs, and also makes it easier and faster its assembly.

For the rest, the flexible portion 2 of the fourth embodiment of the invention is similar to that of the third embodiment. In fact, both the elongated body 300 and the cup-shaped part 133 of the intermediate articulated elements 103 have a blind hole 34. FIG. 21 shows in detail the blind hole 34 in the cup-shaped part 133, coaxial to the central axis c. The blind hole 34 is suitable for housing and suitably retaining a permanent magnet 35 (FIG. 19). The threaded stem 192 of the intermediate articulated elements 103 and the stem 193, also threaded, of the cup-shaped part 122 of the terminal articulated element 113, which are made of a ferrous material, are attracted by the permanent magnet 35, with consequent straightening of the flexible portion 2 of the mandrel before it is introduced into a pipe to be bent. It is clear that the variant of the intermediate and terminal articulated elements with the peripheral part integrated with the cup-shaped part, as well as the variant of the rectilinear portion of the mandrel having the spherical seat obtained in the elongated body, are also applicable to the other embodiments of the present invention described above.

Figure 23:
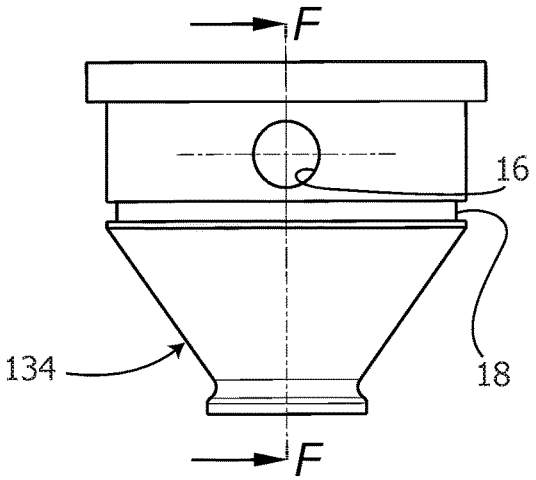
FIG. 23 is a side view of a fourth variant of a cup-shaped part of the intermediate articulated element according to the present invention.
Figure 24:
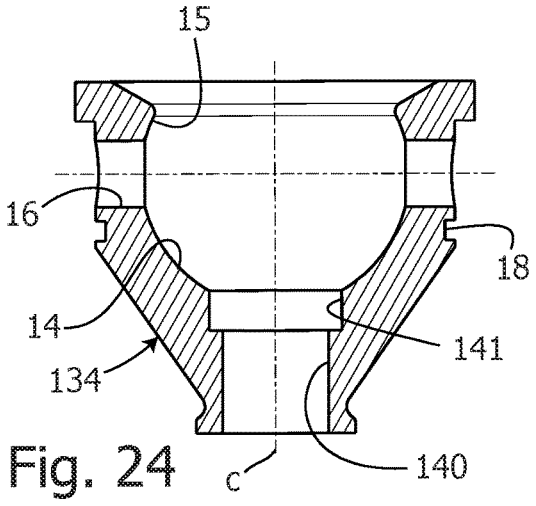
FIG. 24 is a cross-section view taken along the line F-F in FIG. 23.

Reference is now made to FIGS. 23 and 24, which are a side view of a fourth variant of a cup-shaped part of an intermediate articulated element according to the present invention and, respectively, a cross-section view obtained along the line F-F in FIG. 23. Comparing the fourth variant of the cup-shaped part 134 with that of the first embodiment (FIG. 4), it is noted that the cup-shaped part 134 of the intermediate articulated element has a through hole 140 coaxial to its central axis c. The through hole 140 is equipped with an abutment 141.

Inserted in the through hole 140 is a stem 194 which, unlike the previous embodiments, constitutes a body distinct from the cup-shaped part 134 and can be considered a first variant of the stem according to the present invention.

Figure 27:
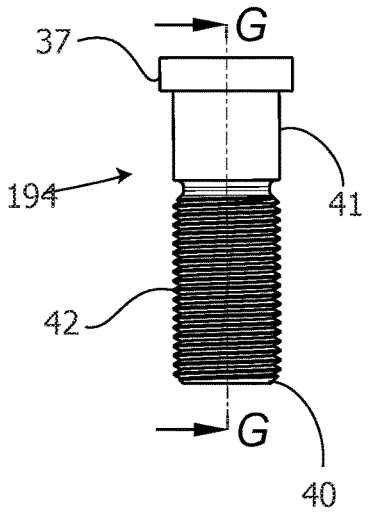
FIG. 27 is a side view of the first variant of the stem in FIG. 25.
Figure 28:
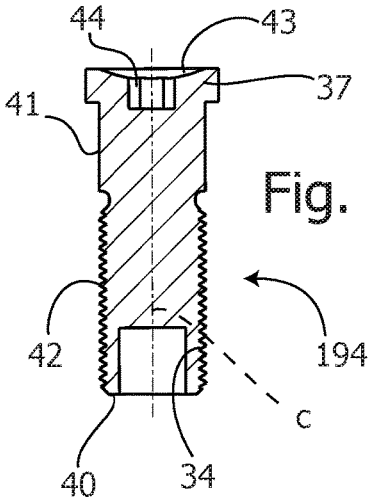
FIG. 28 is a cross-section view taken along the line G-G in FIG. 27.
Figure 26:
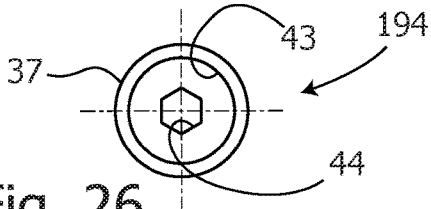
FIG. 26 is a front end view of the first variant of the stem in FIG. 25.
Figure 25:
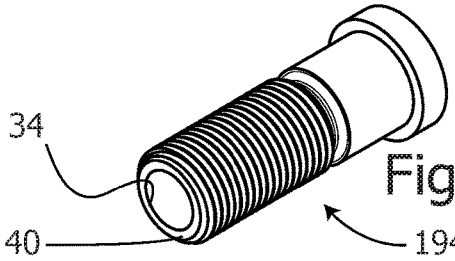
FIG. 25 is an axonometric view of a first variant of the stem according to the present invention.
Figure 48:
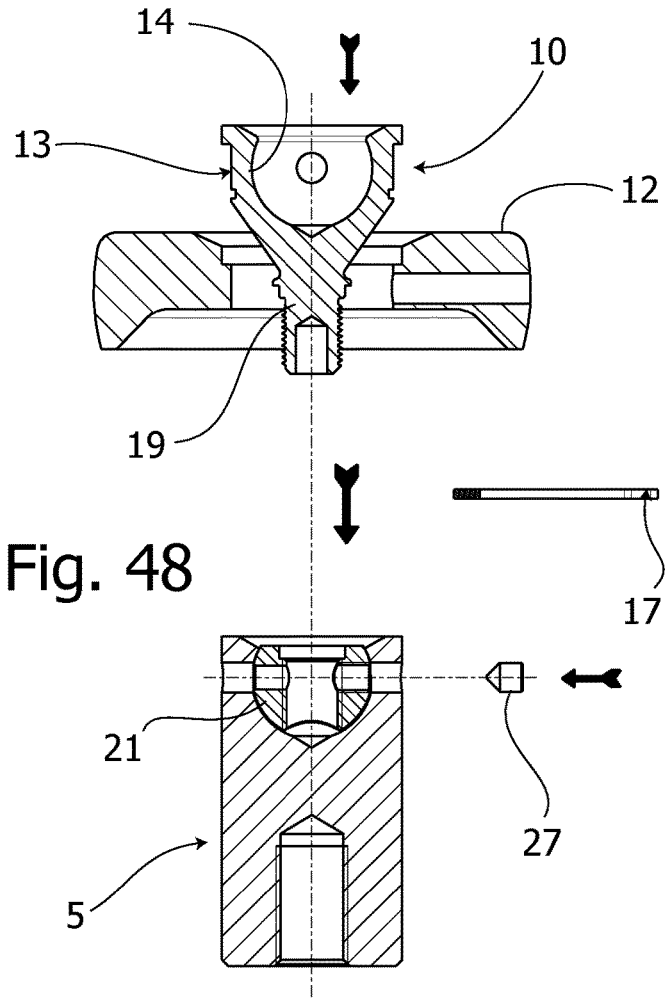
FIGS. 46 to 49 are partially exploded cross-section views that explain schematically subsequent assembly phases of a mandrel according to the present invention.

The stem 194 is shown in FIG. 25 in an axonometric view, in FIG. 26 in a front end view, in FIG. 27 in a side view, and in FIG. 28 in a cross-section view taken along the line G-G in FIG. 27. The stem 194 of axis c, like the cup-shaped part, is equipped with a head 37, a smooth proximal portion 41 and a threaded distal portion 42.

Figure 29:
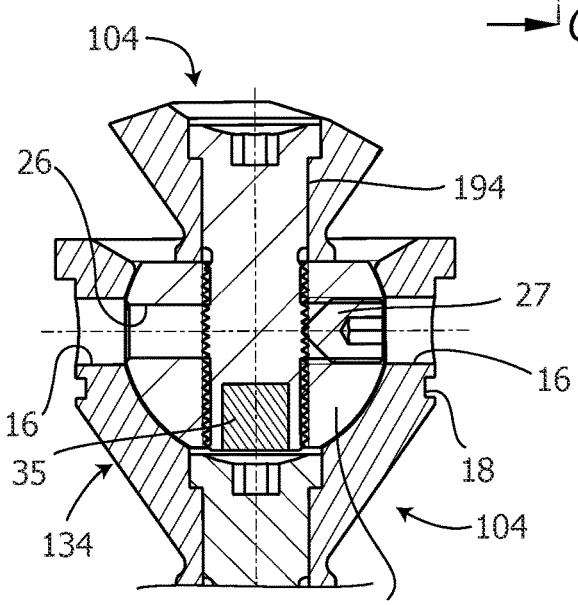
FIG. 29 is a partial longitudinal cross-section view of two intermediate articulated elements using the fourth variant of the cup-shaped part in FIG. 23 and the first variant of the stem in FIG. 25.

The stem 194 has, in the end of the head 37, coaxially with the axis c, a depression 43 with a spherical cap and a recess 44 preferably hexagonal for screwing the stem 194. In an end 40 opposite the head 37 there is a blind hole 34 as the seat for a permanent magnet 35 shown in FIG. 29, which is a partial longitudinal cross-section view of two intermediate articulated elements 104 using the fourth variant of the cup-shaped part in FIG. 23 and the first variant of the stem in FIG. 25.

To assemble the embodiment of the mandrel shown in its intermediate articulated elements 104, 104, the spherical part 21 is inserted into the spherical seat 14 of the cup-shaped part 134. The stem 194 forming part of the consecutive intermediate articulated element 104, complete with permanent magnet 35 in its cylindrical seat 34, is screwed by means of a key into the main threaded hole 24 of the spheroidal part 21 by acting on the recess 44 in the head 37 of the stem 194. To complete the ball joint, a set screw 27 is inserted through a secondary hole 16 until it comes into contact with the thread 42 of the stem 194. The spheroidal part 21 is thus constrained in the spherical seat 14 of the cup-shaped part 134, retaining the articulated element. The spherical cup-shaped depression 43 allows the oscillation of the intermediate articulated element 104 with respect to the previous element thanks to the mutual contact between the free end 40 of a stem and the head 37 of the previous stem.

The fourth variant of the cup-shaped part 134 and the second variant of the stem 194 cooperate in the constitution of an intermediate articulated element 104 formed by an additional component compared to the previous variants but allow a simpler manufacture of the mandrel and the rapid replacement of damaged or worn parts.

Reference is made now to FIGS. 30, 31 and 32, which are a side view of a fifth variant of cup-shaped part 135, in one piece with a stem 195 according to the present invention, a cross-section view taken along the line H-H in FIG. 30 and, respectively, a front end view of the fifth variant of the cup-shaped part in FIG. 30.

The fifth variant of the cup-shaped part 135 cooperates for the constitution of the intermediate articulated element 105, shown in partial longitudinal cross-section view in FIG. 37, with a first variant of the spheroidal part 210, represented in FIGS. 33, 34, 35 and 36, which show the spheroidal part 210 in an axonometric view, in a rear end view, in a cross-section view taken along line I-I in FIG. 34, and in top plan view.

The main difference of the intermediate articulated element 105, for example with respect to the articulated element 102 of the third embodiment of the mandrel, is that the stem 195 is not threaded, but is smooth and has a lateral indentation 36. Preferably, the lateral indentation 36 is angled in longitudinal cross-section view with one side substantially perpendicular to the axis c of the intermediate articulated element 195.

The spheroidal part 210 is provided with a tertiary threaded hole 260 which has an inclined axis i with respect to the central axis s of the main hole 240, which is smooth, that is not threaded. The tertiary threaded hole 260, which communicates with the main hole 240 of the spheroidal part 210, is adapted to receive a set screw 270. The set screw 270 has a flattened end opposite its lowered head. To allow a convenient screwing of the set screw into the tertiary threaded hole 260, a recess 38 is made in the circumferential edge 15 of the cup-shaped part 135. When this is coaxial with the tertiary threaded hole 260, the set screw 270 is able to reach the lateral indentation 36 of the stem 195 and its flattened end abuts the side of the lateral indentation 36 substantially perpendicular to the axis c. In this way, the position of the stem 195 of the articulated element is locked, when inserted in the main hole 240 of the spheroidal part 210, to prevent its rotation and translation. Consequently, the rotation and translation of the cup-shaped part 135 in one piece with the stem 195 is also prevented. Even if not shown in the figures, the stem 195 in the fifth variant of the cup-shaped part 135 can be used for a terminal articulated element.

Referring to FIG. 37, in which two intermediate articulated elements 105 use the fifth variant of the cup-shaped part in FIG. 30 and the second variant of the spheroidal part 210 in FIG. 33, the assembly of an intermediate articulated element 105 on the previous one is shown.

Initially, the spheroidal part 210 is inserted into the spherical seat 14 of the cup-shaped part 135, after which a permanent magnet 35 is inserted into its blind hole 34. The stem 195 of a consecutive intermediate articulated element 105 is introduced into the spheroidal part 210. Then, along the recess 38 in the circumferential edge 15 of the cup-shaped part 135 and through the tertiary threaded hole 260, arranged coaxially with the recess 38, the set screw 270 is screwed until it penetrates with its tip into the lateral indentation 36 of the stem 195 correctly rotated. The free end of the stem 40 is beveled to allow the oscillation of the cup-shaped part 135 with respect to the permanent magnet 35.

It is understood that the advantage of the fifth variant of the cup-shaped part 135 and relative stem 195 and of the second variant of the spheroidal part 210 lies above all in the constructive simplicity which does not require the threaded coupling between the stem 195 and the spheroidal part 210. The number of components of the articulated element 105 is smaller than that of the articulated element 104.

Reference is now made to FIGS. 38, 39 and 40, which are a side view of a sixth variant of cup-shaped part 136 according to the present invention, a cross-section view taken along the line L-L in FIG. 39 and, respectively, an end front view of the sixth variant of the cup-shaped part in FIG. 38.

The sixth variant is similar to the fourth variant of cup-shaped part 134 (FIG. 23), having a through hole 140 coaxial to its central axis and equipped with an abutment 141. The cup-shaped part 136, like the cup-shaped part cup 135 of the fifth variant, has a recess 38 on the circumferential edge 15 and is devoid of the secondary transverse holes 16 of the fourth variant.

Inserted in the through hole 140 is a second variant of stem 196 that, like the stem 195 of the fifth variant, is unthreaded and, like the first variant of stem 194, constitutes a body distinct from the cup-shaped part 136 and can be considered a second variant of stem according to the present invention.

The stem 196 is shown in FIG. 41 in an axonometric view, in FIG. 42 in rear end view, in FIG. 43 in side view, and in FIG. 44 in a cross-section view taken along the line M-M in FIG. 43. The stem 196, of axis c like the cup-shaped part, it is equipped with a head 37 with a spherical cap-shaped depression 43 and is smooth. In the end 40 opposite the head 37 there is a blind hole 34 for a permanent magnet 35. The sixth variant of the cup-shaped part 136 cooperates for the constitution of the intermediate articulated element 106 with the second variant of the spheroidal part 210, represented in the FIGS. 33, 34, 35 and 36, cited above.

The main difference of the intermediate articulated element 106 with respect to the articulated element 105 lies in the fact that the stem 196 is not in one piece with the cup-shaped part 136. As already mentioned, the spheroidal part 210 is provided with a threaded hole tertiary 260 with axis inclined i with respect to the central axis s of the main hole 240, which is smooth, that is, not threaded. The tertiary threaded hole 260, which communicates with the main hole 240 of the spheroidal part 210, is adapted to receive a set screw 270. To allow convenient screwing of the set screw into the tertiary threaded hole 260, in the circumferential edge 15 of the cup-shaped part 136 is obtained a recess 38, as in the fifth variant of the cup-shaped part 135 of FIG. 31. When the recess 38 is coaxial to the tertiary threaded hole 260, the set screw 270 is able to reach the lateral indentation 36 of the stem 196, as already described for the stem 195 of the fifth variant of the cup-shaped part 135. In this way, the position of the articulated element stem 196, when inserted in the main hole 240 of the spheroidal part 210, is locked to prevent its rotation and translation.

The assembly of an intermediate articulated element 106 on the previous one is shown, referring to FIG. 45, which is a partial longitudinal cross-section view of two intermediate articulated elements 106. Each intermediate articulated element 106 uses the sixth variant of cup-shaped part 136 in FIG. 38, the second variant of the stem 196 and the second variant of the spheroidal part 210 in FIG. 33.

Initially, the spheroidal part 210 is inserted in the spherical seat 14 of the cup-shaped part 136. Then, in the main hole 240 the second variant of the rod 36 is inserted after a permanent magnet 35 is inserted in its blind hole 34. Then, along the recess 38 in the circumferential edge 15 of the cup-shaped part 136 and through the tertiary threaded hole 260, arranged coaxially with the recess 38, the set screw 270 is screwed until it penetrates with its tip into the lateral indentation 36 of the stem 196 properly rotated. The free end 40 of the stem 196 is received in the spherical cap-shaped depression 43 of the consecutive stem 196, to allow the oscillation of the intermediate articulated element 106.

It is understood that the advantage of the sixth variant of the cup-shaped part 136 and relative stem 196 and of the second variant of the spheroidal part 210 lies above all in the constructive simplicity which does not require the threaded coupling between the stem 196 and the spheroidal part 210, while the number of components of the articulated element 106 is the same as that of the articulated element 104.

It should be understood that the invention, in its various embodiments and variants, achieves the intended purposes, in particular that each articulated element is not constructed in two symmetrically equal parts to be kept constantly together even when the mandrel is disassembled. Mandrel assembly times are reduced while its resistance in use increases. In particular, in the integrated form of the elongated body 300, of the intermediate articulated elements 103 and terminal articulated element 113, the manufacturing costs of the mandrel and its assembly times are further reduced, while its resistance in use increases.

Figure 46:
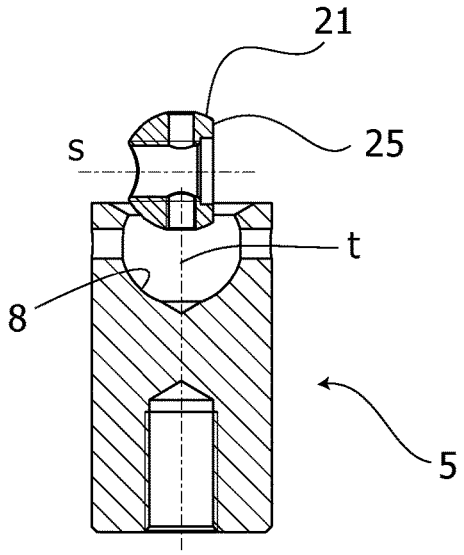
Figure 49:
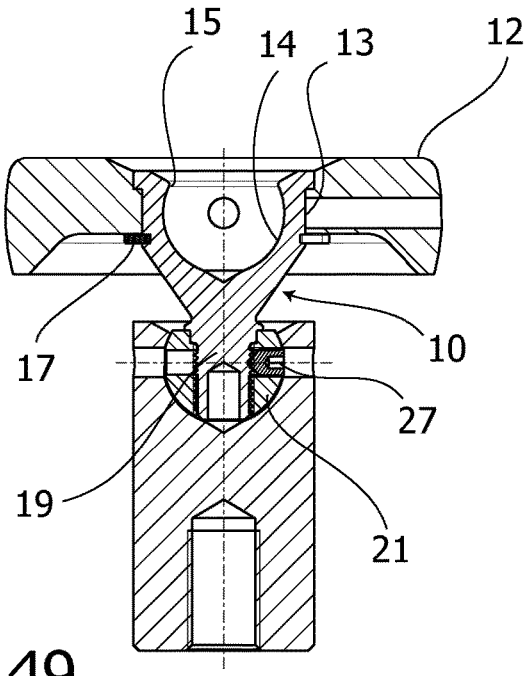
Figure 47:
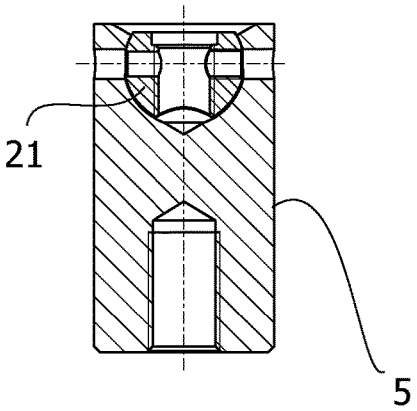

FIGS. 46 to 49 are partially exploded cross-section views, which summarize schematically subsequent assembly steps of a mandrel according to the present invention. In particular, the connection of an intermediate articulated element to the elongated body of the mandrel is shown. First, the spheroidal part 21 in one piece, which is shaped like a peripherally lightened sphere, is introduced into the spherical seat 8 of the insert 5 of the elongated body 3 of the mandrel. This is allowed by the fact that the spheroidal part 21 is bounded by a flat face 25 by means of a secant plane perpendicular to the central axis s of the spheroidal part. As shown in FIG. 46, the spheroidal part 21 is introduced into the spherical seat 8 with an arrangement such that its central axis s is orthogonal to the central axis t of the elongated body 3, and therefore of the insert 5. FIG. 47 shows that the spheroidal part 21 is rotated by 90° to be housed in the spherical seat 8 of the elongated body 3. Subsequently (FIG. 48), the intermediate articulated element 10 in one piece is introduced into its peripheral part 12 and held there by an elastic element 17. As shown in FIG. 49, the intermediate articulated element 10 is screwed with its stem 19 into the spheroidal part 21, inserted into the spherical cavity 8 of the insert 5 and held there by a set screw 27.

It should be understood that, according to the present invention, both the spheroidal part and the intermediate articulated element are made in one piece. This improves the ease of manufacturing of the mandrel components, the ease of assembly, but above all the overall mechanical strength of the mandrel. In fact, unlike the known art, there are no means for retaining the spheroidal part in the respective spherical seats. The holding means are in fact more likely than others to yield, especially due to wear, and put out of use a mandrel built according to the teachings of the known art.

The invention claimed is:

1. A mandrel for a pipe bending machine, comprising:

an elongated body (3; 300) having a central axis (t), a first end connected to a mandrel rod and a second end, opposite to the first one, in which there is a spherical seat (8);

a terminal articulated element (11; 111; 112; 113) having a peripheral part (12; 121) which is configured so as to rest on an internal wall of a pipe (T) to be curved; and an intermediate articulated element (10; 101; 102; 103; 104; 105; 106) comprising:

a peripheral part (12; 121) which is configured so as to rest on an internal wall of a pipe (T) to be curved;

a cup-shaped part (13; 131; 132; 133; 134; 135; 136) in one piece, having a central axis (c) and being equipped with a spherical seat (14) with an opening delimited by a circumferential edge (15), and an articulated element stem (19; 191; 192; 194; 195; 196) extending externally from the cup-shaped part (13; 131; 132; 133; 134; 135; 136) along the central axis (c) of the cup-shaped part and terminating in a stem end (40); and a spheroidal part (21; 210) in one piece that has a central axis(s), is delimited by a flat face (25) by a secant plane perpendicular to the central axis(s) to have a height that enables the spheroidal part to be introduced into the spherical seat (8) in the elongated body (3; 300) and retained therein by the circumferential edge (15) of the elongated body (3; 300), when located within the spherical seat and oriented such that the secant plane is perpendicular to the central axis (c) of the cup-shaped part, is the only portion of the intermediate articulated element in contact with the spherical seat, and that has a main hole (24; 240) directed along the central axis(s) of the spheroidal part (21; 210).

2. The mandrel according to claim 1, wherein the terminal articulated element (11; 111; 112; 113) comprises:

an externally cup-shaped part (120; 122) in one piece, having a central axis, and a terminal articulated element stem (193) extending externally from the cup-shaped part (120; 122) along the central axis of the cup-shaped part, and a spheroidal part (21; 210) in one piece that has a central axis(s), is delimited by a flat face (25) by a secant plane perpendicular to the central axis(s) to have a height that enables the spheroidal part to be introduced into the spherical seat (14) in the cup-shaped part (13; 131; 132; 133; 134; 135; 136) of the intermediate articulated element and retained therein by the circumferential edge (15) of the elongated body (3; 300), when located within the spherical seat and oriented such that the secant plane is perpendicular to the central axis (c) of the cup-shaped part, is the only portion of the intermediate articulated element in contact with the spherical seat, and that has a main hole (24; 240) directed along the central axis(s) of the spheroidal part (21; 210).

3. The mandrel according to any one of claims 1 and 2, wherein the main hole (24) of the spheroidal part (21) is threaded, the articulated element stem (19; 191; 192; 193; 194) is threaded, the spheroidal part (21) is provided with at least one secondary threaded hole (26) which has a transverse axis (r) perpendicular to the central axis(s) of the main threaded hole (24) and is suitable for receiving a set screw (27) capable of locking the articulated element stem (19; 191; 192; 193; 194) screwed into the main threaded hole (24) of the spheroidal part (21).

4. The mandrel according to any one of claims 1 and 2, wherein the cup-shaped part (135; 136) has a recess (38) in the circumferential edge (15), the articulated element stem (195; 196) is smooth and has a side notch (36), the main hole (240) of the spheroidal part (210) is smooth, the spheroidal part (210) is provided with a tertiary threaded hole (260) which has an inclined axis (i) with respect to the central axis(s) of the main hole (240), is communicating with the main hole (240) and is able to receive a set screw (270), when the recess (38) is concentric to the tertiary threaded hole (260), the set screw (270) being suitable for reaching the side notch (36) of the stem (195; 196) so as to lock the position of the articulated element stem (195; 196), when inserted in the main hole (240) of the spheroidal part (210), in order to prevent any rotation and shift of the articulated element stem (195; 196).

5. The mandrel according to claim 3, wherein the articulated element stem (19; 191; 192; 195) is in one piece with the cup-shaped part (13; 131; 132; 135) of intermediate articulated element.

6. The mandrel according to claim 4, wherein the cup-shaped part (134; 136) of intermediate articulated element has a through hole (140) concentric to its central axis (c) equipped with a shoulder step (141); and the articulated element stem (194; 196), provided with a head (37), is adapted to be inserted in the through hole (140) of the cup-shaped part (134; 136) with its head (37) abutting the shoulder step (141).

7. The mandrel according to claim 3, wherein the elongated body (3) has a cylindrical cavity made in its second end;

an insert (5) is housed in said cylindrical cavity and connected by a screw (7) to the elongated body (3), which is in turn connected in its first end to the mandrel rod by means of a threaded coupling;

the spherical seat (8) is in the insert (5) and is provided with at least one hole (9), which is perpendicular to the central axis (t) of the elongated body (3) and is suitable for allowing the passage of the set screw (27) when the spheroidal part (21) is inserted in the spherical seat (8) and the hole (9) is concentric to the secondary threaded hole (26) of the spheroidal part (21).

8. The mandrel according to claim 3, wherein the elongated body (300), suitable for being connected at its first end to a mandrel rod by means of a threaded coupling, has at its second end the spherical seat (8) provided with at least one hole (90), which is perpendicular to the central axis (t) of the elongated body (3), and is communicating with the inside of the pipe (T), hole (90) being suitable to allow the passage of the set screw (27) when the spheroidal part (21) is inserted in the spherical seat (8) and the hole (90) is concentric to the secondary threaded hole (26) of the spheroidal part (21).

9. The mandrel according to claim 4, wherein the peripheral part (12) has a central hole, in which the intermediate articulated element (10; 101; 102) is inserted and retained, by both an abutment formed in the cup-shaped part (135; 136) and an elastic ring (17) housed in a groove (18) in the cup-shaped part (135; 136).

10. The mandrel according to claim 3, wherein the peripheral part (12) has a central hole, in which the intermediate articulated element (10; 101; 102; 104) is inserted and retained by both an abutment formed in the cup-shaped part (13; 131; 132; 134) and, an elastic ring (17) housed in a groove (18) in the cup-shaped part (13; 131; 132; 134), and the cup-shaped part (13; 131; 132; 134) in one piece is provided with at least one hole (16), which is perpendicular to its central axis (c), and is suitable for allowing the passage of the set screw (27) when the spheroidal part (21) is inserted in the spherical seat (14) and the hole (16) is concentric to the secondary threaded hole (26) of the spheroidal part (21).

11. The mandrel according to claim 3 wherein the peripheral part (121) is in one piece with the cup-shaped part (133) of its intermediate articulated element (103) and is provided with at least one hole (160) which connects the inside of the pipe (T) with the spherical seat (14) of the cup-shaped part (133) of the intermediate articulated element (103), the hole (160) being perpendicular to its central axis (c), and being suitable to allow the passage of the set screw (27) when the spheroidal part (21) is inserted in the spherical seat (14), and the hole (160) is concentric to the secondary threaded hole (26) of the spheroidal part (21).

12. The mandrel according to claim 2, wherein the peripheral part (12) has a central hole, and the cup-shaped part (120) of the articulated terminal element (11; 111; 112) is inserted in the central hole of its peripheral part (12) retained by both an abutment formed in the cup-shaped part (120) of the terminal element (11; 111; 112) and an elastic ring (17) housed in a groove (18) formed in the cup-shaped part (120) of articulated terminal element (11; 111; 112).

13. The mandrel according to claim 2, wherein the peripheral part (121) is in one piece with the cup-shaped part (122) of the articulated terminal element (113).

14. The mandrel according to claim 1, wherein the stem (19) in each intermediate articulated element (10) has a blind hole (31) suitable for housing a coil spring (28) that is pre-compressed, and a ball (29), and the spherical seat (8) of the elongated body (3) and the spherical seat (14) of the cup-shaped part (13) in each intermediate articulated element (10) has a depression (30) in the shape of a spherical cap having an axis coinciding with the central axis (t) of the elongated body (3), and with the central axis (c) of the cup-shaped part (13), respectively, the depression (30) being suitable to receive and retain the ball (29) loaded by the coil spring (28) into the blind hole (31) of the stem (19).

15. The mandrel according to claim 1 wherein the spherical seat (8) of the elongated body (3) and the spherical seat (14) of the cup-shaped part (131) in the intermediate articulated element (101) have a blind hole (32), extending into the elongated body (3) along the axis (t) and in the cup-shaped part (131) along the central axis (c), in which a pre-compressed coil spring (28) and a ball (29) are housed, and the stem (191) in the intermediate articulated element (101) has a recess (33) in the shape of a spherical cap having an axis coinciding with the central axis (c) of the cup-shaped part (131), adapted to receive and retain the ball (29) loaded by the coil spring (28) in the blind hole (32) of the elongated body (3) and of the intermediate articulated element (101).

16. The mandrel according to claim 1, wherein the spherical seat (8) in the elongated body (3) and the spherical seat (14) in the cup-shaped part (132; 133; 135) of the intermediate articulated element (102; 103) have a blind hole (34), extending from the respective spherical seat (8; 14), along the central axis (t, c), blind hole (34) which houses a permanent magnet (35) suitable for exerting an attractive force on a consecutive intermediate articulated element (102; 103) and on the terminal articulated element (112; 113), so as to keep the mandrel straight against the force of gravity, when not in use.

17. The mandrel according to claim 1, wherein the stem (194; 196) extending externally from the cup-shaped part (134; 136) has a blind hole (34) in its end (40) in which a permanent magnet is housed (35) adapted to exert an attractive force on a consecutive intermediate articulated element and on the terminal articulated element so as to keep the mandrel straight against the force of gravity, when not in use.

18. A mandrel for pipe bending machine, comprising:

an elongated body (3; 300) having a central axis (t), a first end connected to a mandrel rod and a second end, opposite to the first one, in which there is a spherical seat (8);

a terminal articulated element (11; 111; 112; 113) having a peripheral part (12; 121) which is configured so as to rest on an internal wall of a pipe (T) to be curved; and an intermediate articulated element (10; 101; 102; 103; 104; 105; 106) comprising:

a peripheral part (12; 121) which is configured so as to rest on an internal wall of a pipe (T) to be curved;

a cup-shaped part (13; 131; 132; 133; 134; 135; 136) in one piece, having a central axis (c) and being equipped with a spherical seat (14) with an opening delimited by a circumferential edge (15), and an articulated element stem (19; 191; 192; 194; 195; 196) extending externally from the cup-shaped part (13; 131; 132; 133; 134; 135; 136) along the central axis (c) of the cup-shaped part and terminating in a stem end (40); and a spheroidal part (21; 210) in one piece that has a central axis(s), is delimited by a flat face (25) by a secant plane perpendicular to the central axis(s) to have a height that enables the spheroidal part to be introduced into the spherical seat (8) in the elongated body (3; 300) and retained therein by the circumferential edge (15) of the elongated body (3; 300), and that has a main hole (24; 240) directed along the central axis(s) of the spheroidal part (21; 210), wherein the main hole (24) of the spheroidal part (21) is threaded, the articulated element stem (19; 191; 192; 193; 194) is threaded, the spheroidal part (21) is provided with at least one secondary threaded hole (26) which has a transverse axis (r) perpendicular to the central axis(s) of the main threaded hole (24) and is suitable for receiving a set screw (27) capable of locking the articulated element stem (19; 191; 192; 193; 194) screwed into the main threaded hole (24) of the spheroidal part (21).

19. A mandrel for pipe bending machine, comprising:

an elongated body (3; 300) having a central axis (t), a first end connected to a mandrel rod and a second end, opposite to the first one, in which there is a spherical seat (8);

a terminal articulated element (11; 111; 112; 113) having a peripheral part (12; 121) which is configured so as to rest on an internal wall of a pipe (T) to be curved; and an intermediate articulated element (10; 101; 102; 103; 104; 105; 106) comprising:

a peripheral part (12; 121) which is configured so as to rest on an internal wall of a pipe (T) to be curved;

a cup-shaped part (13; 131; 132; 133; 134; 135; 136) in one piece, having a central axis (c) and being equipped with a spherical seat (14) with an opening delimited by a circumferential edge (15), and an articulated element stem (19; 191; 192; 194; 195; 196) extending externally from the cup-shaped part (13; 131; 132; 133; 134; 135; 136) along the central axis (c) of the cup-shaped part and terminating in a stem end (40); and a spheroidal part (21; 210) in one piece that has a central axis(s), is delimited by a flat face (25) by a secant plane perpendicular to the central axis(s) to have a height that enables the spheroidal part to be introduced into the spherical seat (8) in the elongated body (3; 300) and retained therein by the circumferential edge (15) of the elongated body (3; 300), and that has a main hole (24; 240) directed along the central axis(s) of the spheroidal part (21; 210), wherein the cup-shaped part (135; 136) has a recess (38) in the circumferential edge (15), the articulated element stem (195; 196) is smooth and has a side notch (36), the main hole (240) of the spheroidal part (210) is smooth, the spheroidal part (210) is provided with a tertiary threaded hole (260) which has an inclined axis (i) with respect to the central axis(s) of the main hole (240), is communicating with the main hole (240) and is able to receive a set screw (270), when the recess (38) is concentric to the tertiary threaded hole (260), the set screw (270) being suitable for reaching the side notch (36) of the stem (195; 196) so as to lock the position of the articulated element stem (195; 196), when inserted in the main hole (240) of the spheroidal part (210), in order to prevent any rotation and shift of the articulated element stem (195; 196).

20. A mandrel for pipe bending machine, comprising:

an elongated body (3; 300) having a central axis (t), a first end connected to a mandrel rod and a second end, opposite to the first one, in which there is a spherical seat (8);

a terminal articulated element (11; 111; 112; 113) having a peripheral part (12; 121) which is configured so as to rest on an internal wall of a pipe (T) to be curved; and an intermediate articulated element (10; 101; 102; 103; 104; 105; 106) comprising:

a peripheral part (12; 121) which is configured so as to rest on an internal wall of a pipe (T) to be curved;

a cup-shaped part (13; 131; 132; 133; 134; 135; 136) in one piece, having a central axis (c) and being equipped with a spherical seat (14) with an opening delimited by a circumferential edge (15), and an articulated element stem (19; 191; 192; 194; 195; 196) extending externally from the cup-shaped part (13; 131; 132; 133; 134; 135; 136) along the central axis (c) of the cup-shaped part and terminating in a stem end (40); and a spheroidal part (21; 210) in one piece that has a central axis(s), is delimited by a flat face (25) by a secant plane perpendicular to the central axis(s) to have a height that enables the spheroidal part to be introduced into the spherical seat (8) in the elongated body (3; 300) and retained therein by the circumferential edge (15) of the elongated body (3; 300), and that has a main hole (24; 240) directed along the central axis(s) of the spheroidal part (21; 210), wherein the spherical seat (8) in the elongated body (3) and the spherical seat (14) in the cup-shaped part (132; 133; 135) of the intermediate articulated element (102; 103) have a blind hole (34), extending from the respective spherical seat (8; 14), along the central axis (t, c), blind hole (34) which houses a permanent magnet (35) suitable for exerting an attractive force on a consecutive intermediate articulated element (102; 103) and on the terminal articulated element (112; 113), so as to keep the mandrel straight against the force of gravity, when not in use.

21. A mandrel for pipe bending machine, comprising:

an elongated body (3; 300) having a central axis (t), a first end connected to a mandrel rod and a second end, opposite to the first one, in which there is a spherical seat (8);

a terminal articulated element (11; 111; 112; 113) having a peripheral part (12; 121) which is configured so as to rest on an internal wall of a pipe (T) to be curved; and an intermediate articulated element (10; 101; 102; 103; 104; 105; 106) comprising:

a peripheral part (12; 121) which is configured so as to rest on an internal wall of a pipe (T) to be curved;

a cup-shaped part (13; 131; 132; 133; 134; 135; 136) in one piece, having a central axis (c) and being equipped with a spherical seat (14) with an opening delimited by a circumferential edge (15), and an articulated element stem (19; 191; 192; 194; 195; 196) extending externally from the cup-shaped part (13; 131; 132; 133; 134; 135; 136) along the central axis (c) of the cup-shaped part and terminating in a stem end (40); and a spheroidal part (21; 210) in one piece that has a central axis(s), is delimited by a flat face (25) by a secant plane perpendicular to the central axis(s) to have a height that enables the spheroidal part to be introduced into the spherical seat (8) in the elongated body (3; 300) and retained therein by the circumferential edge (15) of the elongated body (3; 300), and that has a main hole (24; 240) directed along the central axis(s) of the spheroidal part (21; 210), wherein the stem (194; 196) extending externally from the cup-shaped part (134; 136) has a blind hole (34) in its end (40) in which a permanent magnet is housed (35) adapted to exert an attractive force on a consecutive intermediate articulated element and on the terminal articulated element so as to keep the mandrel straight against the force of gravity, when not in use.

* * * * *